US008081905B2

(12) United States Patent
Matsuda

(10) Patent No.: US 8,081,905 B2
(45) Date of Patent: Dec. 20, 2011

(54) IMAGE FORMING APPARATUS AND METHOD OF CORRECTING ROTATION ANGULAR VELOCITY OF IMAGE BEARING MEMBER

(75) Inventor: Hiromichi Matsuda, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 975 days.

(21) Appl. No.: 11/777,107

(22) Filed: Jul. 12, 2007

(65) Prior Publication Data

US 2008/0013972 A1 Jan. 17, 2008

(30) Foreign Application Priority Data

Jul. 13, 2006 (JP) ..... 2006-193028

(51) Int. Cl.
*G03G 15/00* (2006.01)

(52) U.S. Cl. ..... 399/167; 399/301

(58) Field of Classification Search ..... 399/301, 399/167, 49; 347/116
See application file for complete search history.

(56) References Cited

U.S. PATENT DOCUMENTS

| | | | | |
|---|---|---|---|---|
| 5,881,346 | A * | 3/1999 | Mori et al. | 399/301 |
| 6,933,696 | B2 | 8/2005 | Ueda et al. | |
| 2003/0086732 | A1* | 5/2003 | Abe et al. | |
| 2005/0009351 | A1* | 1/2005 | Takahashi et al. | |
| 2005/0286937 | A1* | 12/2005 | Kim et al. | |
| 2007/0268358 | A1* | 11/2007 | Noguchi et al. | |

FOREIGN PATENT DOCUMENTS

| | | | |
|---|---|---|---|
| JP | 05-289455 | | 11/1993 |
| JP | 10-078734 | | 3/1998 |
| JP | 11249526 | A * | 9/1999 |
| JP | 2000-284562 | | 10/2000 |
| JP | 2005031126 | A * | 2/2005 |
| JP | 2005-080378 | | 3/2005 |
| JP | 2006011028 | A * | 1/2006 |
| JP | 2006047920 | A * | 2/2006 |

OTHER PUBLICATIONS

Office Action dated Feb. 22, 2011 in corresponding Japanese Patent Application No. 2006-193028.

* cited by examiner

*Primary Examiner* — David Porta
*Assistant Examiner* — Milton Gonzalez
(74) *Attorney, Agent, or Firm* — Harness, Dickey & Pierce, PLC

(57) ABSTRACT

An image forming apparatus including an image bearing member, an image forming device forming a latent image on the image bearing member and visualizing the latent image; a transfer device transferring the visual image onto a receiving material, using a moving member; a drive controller controlling driving of the image bearing member so that the rotation angular speed of the image bearing member is identical to the targeted rotation angular speed; a pattern detection device detecting pattern images formed on the moving member; and a correction device determining the variation in rotation angle or angular speed per one revolution of the image bearing member on the basis of the detection data and correcting the targeted rotation angular speed by superimposing a correction value to negate the variation in rotation angle or angular speed per one revolution of the image bearing member on the target.

9 Claims, 10 Drawing Sheets

IMAGE FORMING APPARATUS AND METHOD OF CORRECTING ROTATION ANGULAR VELOCITY OF IMAGE BEARING MEMBER

BACKGROUND OF THE INVENTION

1. Field of the Invention

The present invention relates to an image forming apparatus, and more particularly to an electrophotographic image forming apparatus for forming images using a rotating image bearing member. In addition, the present invention also relates to an image forming method.

2. Discussion of the Background

Image forming apparatuses such as copiers, facsimiles and printers typically perform the following image forming processes.

(1) an electrostatic latent image is formed on an image bearing member (latent image forming process);
(2) the electrostatic latent image is developed with a developer including a toner to form a toner image on the image bearing member (developing process); and
(3) the toner image is transferred onto a receiving material optionally via an intermediate transfer medium (transferring process).

In addition, color image forming apparatuses in which plural color images (such as yellow, magenta, cyan and black images) are overlaid to form a multi-color image or a full color image are well known. Recently, such color image forming apparatuses are required to produce high quality color images at a high speed. Specific examples of such color image forming apparatuses include tandem full color image forming apparatuses using a direct image transfer method in which black (K), yellow (Y), magenta (M) and cyan (C) images formed on the respective image bearing members are transferred onto a receiving material fed by a feeding belt (serving as a moving member) to overlay the color images, resulting in formation of a full color image. It is possible that such direct transfer image forming apparatuses cause a misalignment problem in that the positions of one or more color images formed on a receiving material are deviated from the predetermined positions to an extent such that a user can notify the misalignment of the color images. When such a misalignment problem occurs, the image qualities deteriorate. For example, misalignment of color line or character images causes image quality problems such that line or character images with a secondary color (such as red, blue and green color images), which can be formed by overlaying plural primary color line or character images (such as Y, M and C color images), cannot be formed; the resultant color images look blurred; and a white area is formed around a character image formed on a background with another color. In addition, a banding problem in that an uneven portion like a band is periodically formed on a colored background is also caused.

In addition, tandem full color image forming apparatuses using an intermediate transfer method in which black (K), yellow (Y), magenta (M) and cyan (C) images formed on the respective image bearing members are transferred onto an intermediate transfer belt (serving as a moving member) so as to be overlaid, and the overlaid color images are transferred onto a receiving material also well known. In such intermediate transfer image forming apparatuses also causes a misalignment problem when the positions of one or more color images formed on an intermediate transfer medium are deviated from the predetermined positions.

The misalignment problem is mainly caused by periodical variation in moving speed of the surface of the image bearing members (such as photoreceptor drums). Specifically, when one of the image bearing members is rotated at uneven rotation speed, the position of the color image is deviated from the positions of the other color images. Such periodical variation in moving speed of the surface of an image bearing member is caused by variation in rotation angular speed of a rotation driving force transmitted to the image bearing member such as transmission errors of a driving force transmission device provided on the shaft of an image bearing member (e.g., eccentricity of gears, and accumulative variations of pitches of gears), and transmission errors of coupling provided such that an image bearing member can be detachably attached to a driving force transmission device of an image forming apparatus, (e.g., slanting and eccentricity of the shaft thereof).

In attempting to suppress the periodical variation in moving speed of an image bearing member (i.e., to prevent the misalignment problem), published unexamined Japanese patent application No. (hereinafter referred to as JP-A) 10-78734 proposes an image forming apparatus. The image forming apparatus checks the periodical variation in moving speed of each of photoreceptor drums and adjust the rotation angular speed of each of the photoreceptor drums to prevent occurrence of the periodical moving speed variation problem. Specifically, a detection pattern (i.e., color toner images) is formed on each of the photoreceptor drums and the color toner images are transferred onto an intermediate transfer medium such that the different color toner images are arranged on the intermediate transfer medium in order of K, Y, C and M color. The thus arranged color toner images are sequentially detected with a pattern detection device to determine whether each of the photoreceptors has a periodical (one revolution) variation component of moving speed. When it is determined that a photoreceptor drum has a periodical variation component, the image forming apparatus adjusts the rotation speed of the photoreceptor drum to correct the variation.

The method for correcting the variation in rotation angular speed of a photoreceptor drum is as follows. The detection result of the detection pattern toner images formed on the intermediate transfer medium is influenced by the following two variations in speed. One of the variations is the variation in the moving speed of the surface of the photoreceptor drum. When the moving speed of the photoreceptor drum varies, the positions of electrostatic latent images formed thereon for forming the detection pattern images vary. In addition, when the toner images formed on the photoreceptor drum by developing the electrostatic latent images are transferred to the intermediate transfer medium, the positions of the toner images (i.e., the detection pattern images) on the intermediate transfer medium vary because the moving speed of the photoreceptor drum varies. In this image forming apparatus, the difference in phase (hereinafter referred to as phase difference) between the writing position of an electrostatic latent image (hereinafter referred to as an image writing position) and the transfer position of a toner image (hereinafter referred to as an image transfer position) is about 180°. This angle is hereinafter referred to as a phase difference. In this regard, the phase difference is defined as follows. Let's assume a virtual plane perpendicular to the rotation shaft of the photoreceptor drum. The image writing position (a position SP in FIG. 8) is connected with the center of the rotation shaft to form a first virtual line. In addition, the image transfer position (a position TP in FIG. 8) is also connected with the center of the rotation shaft to form a second virtual line. The phase difference is defined as the angle formed by the first and second virtual lines and is an angle $\phi$ in FIG. 8. Then the detection result is multiplied by ½ and phased inverted. The rotation of the photoreceptor drum is controlled using a value obtained by superimposing the correction value on the targeted rotation angular speed of the photoreceptor drum before correction. It is described therein that the periodical variation can be negated by this technique.

The above-mentioned adjustment technique has an assumption such that the phase difference between the image writing position and the image transfer position is about 180°. Therefore, the image forming apparatus is restricted in view of layout of image forming elements.

When the phase difference is different from 180°, a proper correction value cannot be obtained, and thereby control error occurs. It is described in JP-A 10-78734 that the allowance of the phase difference is 180°±45°. Within such a wide allowance, images satisfying the recent requirement for high image quality cannot be produced. For example, when the phase difference is set to 145° in an image forming apparatus, the photoreceptor drum thereof has a radius of 0.20 mm, and is rotated while the moving speed thereof varies by about 0.1% due to eccentricity of a gear driving the photoreceptor drum, the difference in position between the ideal image transfer position of the intermediate transfer medium at which an image is to be transferred and the real image transfer position of the intermediate transfer medium after making the above-mentioned correction is as large as about 12 μm. Hereinafter this difference is referred to as a transfer position difference. When a color image with such a transfer position difference is produced, users can notice misalignment of the image. In recent years, the tolerance level of misalignment of high quality image forming apparatuses is from 40 to 80 μm. Since the variation in moving speed is one of various factors influencing the misalignment of image in an image forming apparatus, the variation of about 12 μm is too large when considering the tolerance level (40 to 80 μm) of the misalignment.

Because of these reasons, a need exists for an image forming apparatus which can reduce the periodical variation in moving speed of the latent image bearing member thereof without restricting the phase difference.

SUMMARY OF THE INVENTION

As an aspect of the present invention, an image forming apparatus is provided which includes at least one image bearing member which is a rotating member and on which an electrostatic latent image is formed at an image writing position; at least one image forming device (including a charging device, a light irradiating device, a developing device, etc.) configured to form the electrostatic latent image on the at least one image bearing member and to develop the electrostatic latent image with a developer including a toner to form a toner image on the at least one image bearing member; a transfer device configured to transfer the toner image onto a receiving material, wherein transfer device includes a moving member selected from a feeding member configured to feed the receiving material so that the toner image on the at least one image bearing member is transferred onto the receiving material at an image transfer position, and an intermediate transfer medium configured to receive the toner image from the at least one image bearing member at an image transfer position and to transfer the toner image to the receiving material; a drive controller configured to control driving of the at least one image bearing member so that a rotation angular speed of the at least one image bearing member is identical to a targeted rotation angular speed; a pattern detection device configured to detect plural detection pattern images formed on the moving member in a moving direction thereof by forming plural electrostatic latent images of the plural detection pattern images on the at least one image bearing member, developing the plural electrostatic latent images with the developer and then transferring the plural detection pattern toner images onto the moving member; and a correction device configured to correct the targeted rotation angular speed.

The correction device operates as follows. A pattern interval variation component representing a periodical variation in moving speed of the at least one image bearing member is extracted from the data of the detection pattern images; the thus extracted pattern interval variation component is corrected on the basis of a phase difference representing an angle between a first virtual line connecting the image writing position and a rotation center of the at least one image bearing member and a second virtual line connecting the image transfer position and the rotation center of the at least one image bearing member to determine an amount of variation in rotation angle or rotation angular speed per one revolution of the at least one image bearing member; the targeted rotation angular speed is corrected by superimposing a correction value, which is an inversion value negating the variation in rotation angle or rotation angular speed per one revolution of the at least one image bearing member, on the targeted rotation angular speed.

As another aspect of the present invention, an image forming method is provided which includes:

forming electrostatic latent detection pattern images on a rotating member at an image writing position so as to be arranged in a moving direction of the rotating member while rotating the rotating member so as to have a targeted rotation angular velocity;

developing the electrostatic latent detection pattern images with a developer including a toner to form detection pattern toner images on the rotating member;

transferring the detection toner images on the rotating member to a moving member (such as intermediate transfer medium) at an image transfer position;

detecting the detection pattern toner images;

extracting a pattern interval variation component representing a periodical moving speed variation of the rotating member from the data of the detection pattern toner images;

correcting the extracted pattern interval variation component on the basis of a phase difference representing an angle between a first virtual line connecting the image writing position and a rotation center of the rotating member and a second virtual line connecting the image transfer position and the rotation center of the rotating member to determine an amount of variation in rotation angle or rotation angular speed per one revolution of the rotating member; and correcting the targeted rotation angular speed by superimposing a correction value which is an inversion value negating the variation in rotation angle or rotation angular speed per one revolution of the rotating member on the targeted rotation angular speed.

BRIEF DESCRIPTION OF THE DRAWINGS

A more complete appreciation of the example aspects of the invention and many of the attendant advantage thereof will be readily obtained as the same better understood by reference to the following detailed description when considered in connection with the accompanying drawings, wherein.

DETAILED DESCRIPTION OF THE INVENTION

Figure 1:
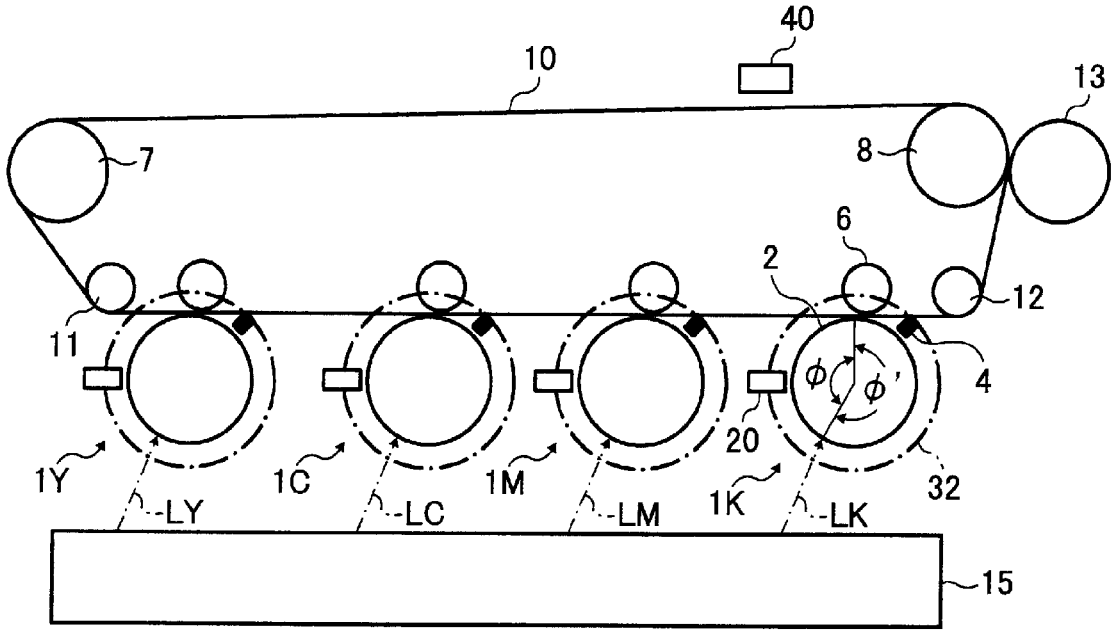
FIG. 1 is a schematic view illustrating the main portion of an example of the image forming apparatus of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent, specification is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present patent invention are described.

At first, an example of the image forming apparatus of the present invention will be explained by reference to FIG. 1. FIG. 1 is a schematic view illustrating the image forming section of a tandem image forming apparatus using an intermediate transfer medium. When the image forming apparatus is used for copiers, printers, etc., the image forming apparatus optionally includes a receiving material feeding section configured to store a large amount of receiving material sheets and feed the sheets one by one, a scanner configured to read the images of original documents, and an automatic document feeder (ADF) configured to feed original documents to the scanner, etc., in addition to the image forming section.

Referring to FIG. 1, the image forming apparatus includes an intermediate transfer belt 10 which is an intermediate transfer medium serving as a moving member and which is an endless belt. The intermediate transfer belt 10 is counterclockwise rotated by four support rollers 7, 8, 11 and 12 while tightly stretched thereby. Among the four support rollers, the roller 8 is a driving roller. A belt cleaning device (not shown) configured to remove toner particles remaining on the surface of the intermediate transfer belt 10 even after a toner image transfer operation is provided on the left side of the intermediate transfer belt 10. Four image forming units 1 (i.e., yellow, cyan, magenta and black image forming units 1Y, 1C, 1M and 1K) are arranged along the lower portion of the intermediate transfer belt, which portion is stretched by the support rollers 11 and 12.

Each of the image forming units 1 includes a photoreceptor drum 2 which serves as an image bearing member and which is clockwise rotated, a drum driving gear 32, and a bias roller 6. In addition, in each image forming unit 1, a charging device (not shown) configured to charge the surface of the photoreceptor drum 2, a developing device (not shown) configured to develop a latent image formed on the photoreceptor drum 2 with a developer including a toner, and a cleaning device (not shown) configured to remove toner particles remaining on the surface of the photoreceptor drum 2 even after a toner image transfer operation, are arranged around the photoreceptor drum 2. The four image forming units have the same configuration except that the color of the toner is different. A combination of devices forming an electrostatic image and a, toner image on the photoreceptor drum (such as charging devices, light irradiating devices and developing devices) is hereinafter sometimes referred to as an image forming device.

The bias roller 6, which serves as a primary transfer member, is arranged so as to face the photoreceptor drum 2 with the intermediate transfer belt 10 therebetween. The intermediate transfer belt 10 is pressure-contacted with the photoreceptor drum 2 by the bias roller 6. A mark 4 is formed on each of the drum driving gears 32 to be detected by a position sensor 20. The position of each of the rotated photoreceptor drums 2 can be determined by the detection result of the corresponding position sensor 20.

A secondary transfer roller 13 serving as a secondary transfer member is provided so as to face the driving roller 8 with the intermediate transfer belt 10 therebetween. The secondary transfer roller 13 is pressed toward the driving roller 8, i.e., the secondary transfer roller is pressure-contacted with the intermediate transfer belt 10, thereby forming a secondary transfer nip between the secondary transfer roller 8 and the intermediate transfer belt 10. A sheet of a receiving material is timely fed toward the secondary transfer nip from a lower side of the image forming section so that a toner image on the intermediate transfer belt 10 is transferred on to a proper position of the receiving material sheet. Not only such a transfer roller as mentioned above but also transfer belts and noncontact chargers can also be used as the secondary transfer member.

Figure 3:
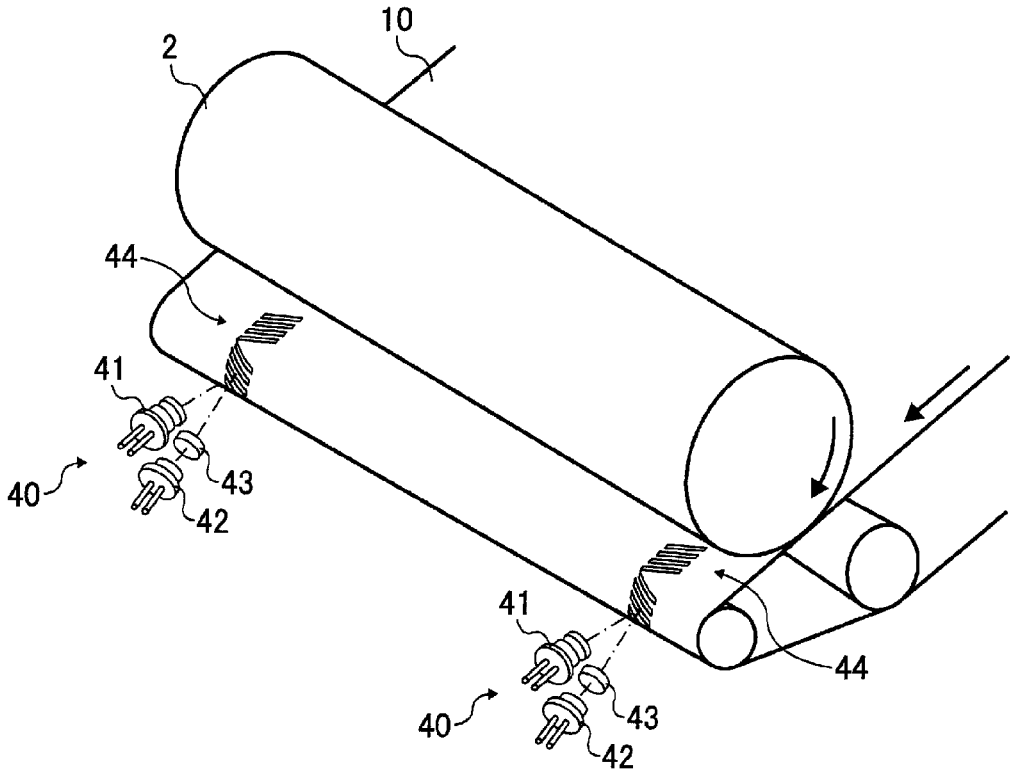
FIG. 3 is a schematic view illustrating the transfer position adjustment pattern images formed on the intermediate transfer medium of the image forming apparatus illustrated in FIG. 1 and a detection device for detecting the pattern images.

A pattern sensor 40 is provided on a downstream side from the secondary transfer nip relative to the moving direction of the intermediate transfer belt 10 so as to face the intermediate transfer belt. The pattern sensor 40 serves as a detector configured to detect pattern images (toner images) formed on the intermediate transfer belt 10. In this example, two pattern sensors are provided in the direction (i.e., the belt width direction) perpendicular to the moving direction of the intermediate transfer belt 10 as illustrated in FIG. 3.

The number of the pattern sensors is not limited to two. By increasing the number of the pattern sensors, the precision of detection can be improved, the detection time can be shortened, and the variation in the main scanning direction can be determined. Specifically, when four pattern sensors are provided, the precision of detection can be improved since the same four patterns of a color image can be detected by the four pattern sensors. In addition, since four pattern color images can be detected at the same time, the detection time can be shortened. Further, when four pattern sensors are provided in the belt width direction, the misalignment of a color image in the belt width direction can be determined.

A light irradiating device 15, which serves as a latent image forming device, is provided under the four image forming units 1. In addition, a fixing device (not shown) configured to fix a toner image on the sheet of the receiving material is provided over the secondary transfer nip.

Further, the image forming apparatus includes a receiving material feeding section configured to store and feed the receiving material sheets, a pair of registration rollers configured to timely feed a sheet of the receiving material to the secondary transfer nip, and a tray configured to stack the sheets bearing a fixed toner image thereon, which are discharged from the main body of the image forming apparatus. In addition, the image forming apparatus can optionally include a manual feeding device from which a sheet of a receiving material can be manually fed to the image forming units, and a sheet reversing device configured to reverse a receiving material sheet bearing a fixed toner image thereon to produce a double-sided copy.

Next, the image forming operation of the image forming apparatus will be explained.

When the image forming apparatus of the present invention is used as a copier, at first original documents are set on an automatic document feeder (ADF) (not shown) or an original document is set on a glass plate of a scanner (not shown) and then pressed to the glass plate by the ADF. When the ADF is used and a start button (not shown) is pressed, the original documents are fed to the glass plate one by one. A scanning member of the scanner is driven to read the image on each of the original documents fed to the glass plate. In the case where an original document is manually set on the glass plate, the image on the original document is read by the scanner after the start button is pressed. When the scanning member is driven, the scanning member irradiates the image of the original document with light, and the light reflected from the image is received by a reading sensor after passing focusing lens, resulting in reading of the image of the original document. Then the following image forming operation is performed on the basis of the thus read image information.

When this image forming apparatus is used as a printer, the following image forming operation is performed on the basis of image information sent from an external device such as personal computers or digital cameras.

In parallel to the image reading operation or the image information receiving operation, a driving motor (not shown) serving as a driving source drives the driving roller 8 to rotate. Thereby, the intermediate transfer belt 10 is counterclockwise rotated and the other support rollers are driven by the intermediate transfer belt to rotate. In addition, each the photoreceptor drums 2 of the image forming units 1 is also driven to rotate. The light irradiating device 15 irradiates the photoreceptors with light beams Ly, Lc, LM and LK to form electrostatic latent images of yellow, cyan, magenta and black color images on the respective photoreceptor drums 2Y, 2C, 2M and 2K. The developing devices develop the electrostatic latent images with the respective developers to form yellow, cyan, magenta and black toner images on the respective photoreceptors. The toner images are transferred onto the intermediate transfer belt 10 by the transfer roller 6 so as to be overlaid, resulting in formation of a combined color toner image on the intermediate transfer belt 10.

In parallel to the image forming operation mentioned above, a sheet of the receiving material is timely fed to the secondary transfer nip. Specifically, sheets of the receiving material in a receiving material sheet cassette (not shown) are fed while separated one by one by a sheet separating device (not shown). The thus fed sheet is temporarily stopped by a pair of registration rollers (not shown) when the tip of the sheet reaches the registration rollers. When a manual sheet tray (not shown) is used, the sheets set on the manual sheet tray are fed to the registration rollers by a feeding roller while separated one by one. The sheet thus fed from the manual sheet tray is also stopped temporarily by the registration rollers. The registration rollers are timely rotated to feed the sheet such that the combined color toner image on the intermediate transfer belt 10 is transferred onto a proper position of the receiving material sheet at the secondary transfer nip. In this regard, the pair of registration rollers are typically grounded. However, a bias can be applied thereto to remove paper dust adhered thereto. At the secondary transfer nip, the combined color toner image on the intermediate transfer belt 10 is transferred on the receiving material sheet due to the secondary transfer bias applied to the secondary transfer roller 13. The receiving material sheet bearing the combined color toner image is then fed to a fixing device (not shown) at which the color toner image is fixed on the sheet upon application of heat and pressure, resulting in formation of a fixed full color image on the sheet. The receiving material sheet bearing the fixed full color image is then discharged from the main body of the image forming apparatus by a discharging roller (not shown) to be stacked on a discharge tray (not shown).

This image forming apparatus can produce not only full (multiple) color images but also monochrome images. For example when a black color image is formed, the intermediate transfer belt 10 is separated from the photoreceptor drums 2Y, 2C and 2M using an attaching/detaching device (not shown) so that the photoreceptor drums 2Y, 2C and 2M are temporarily inactivated.

This image forming apparatus has a short and simple sheet feeding path (a path from the cassette to the discharge tray), and therefore the image forming apparatus has high copy productivity with hardly causing a jamming problem in that a receiving material sheet is jammed in the path. However, in order that the receiving material sheet is fed upward at the secondary transfer nip, the light irradiating device 15 has to be provided under the image forming units 1. Therefore, toner particles scattered from the image forming units 1 and the intermediate transfer belt 10 tend to fall on the light irradiating device 15. In order to prevent parts of the light irradiating device 15 from being contaminated by scattered toner particles, a cover is provided on the light irradiating device. However, on the other hand, the light irradiating device has to irradiate the photoreceptor drums with light. Therefore, the portions of the cover through which the light irradiating device emits light beams to irradiate the photoreceptor drums are made of a lens (hereinafter referred to as irradiation lens) In order to prevent deposition of toner particles on the lenses (which results in formation of improper latent images), the writing positions, at which light beams $L_Y$, $L_C$, $L_M$ and $L_K$ irradiate the photoreceptor drums, are located so as not to be right below the respective photoreceptor drums 2Y, 2C, 2M and 2K. Specifically, in this image forming apparatus, the angle $\phi$ formed by the primary transfer nip (i.e., the image transfer position, which is the top of the photoreceptor drum) and the image writing position is 145°. In this regard, the surface of the irradiation lens can be slanted and therefore toner particles fallen on the lens slip from the surface of the lens. Therefore, the fallen toner particles are hardly deposited on the surface of the lens.

Next, the drum driving device for driving the corresponding photoreceptor drum will be explained.

Figure 2:
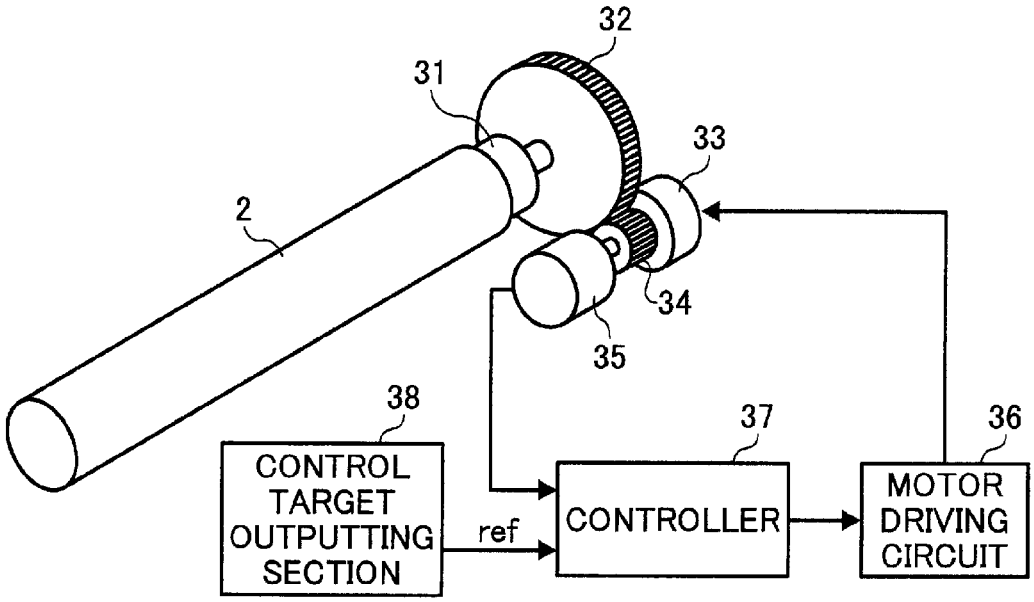
FIG. 2 is a schematic view illustrating an example of the driving device for driving the photoreceptor drum of the image forming apparatus illustrated in FIG. 1.

FIG. 2 is a schematic view illustrating a driving device for driving the corresponding photoreceptor drum 2. Each of the photoreceptor drums 2 has the same driving device.

In this example, the rotation shaft (drum shaft) of the photoreceptor drum 2 is rotatably supported by a frame (not shown) of the main body of the image forming apparatus. The driving device includes a driving motor 33 (such as stepping motors and DC servo motors), a motor shaft gear 34 provided on a shaft of the driving motor, a drum driving gear 32 provided on a driving shaft so as to be engaged with the motor shaft gear 34, and a coupling 31 configured to connect the drum shaft with the driving shaft.

The driving device of this example is a one-step reduction mechanism including two gears, i.e., the motor gear 34 and the drum driving gear 32. This is because the number of constituent parts is reduced, resulting in reduction of the costs and transmission errors caused by variation of teeth of the gears and eccentricity of the gears. Since a one-step reduction mechanism is used, the diameter of the drum driving gear 32 becomes larger than the diameter of the photoreceptor drum 2 if the reduction ratio is high. By using such a large diameter drum driving gear, variation in rotation speed of the photoreceptor drum 2 caused by variation of one tooth of the gear can be reduced, resulting in reduction in image density unevenness (i.e., banding) in the sub-scanning direction. The reduction ratio is determined depending on the targeted rotation speed of the photoreceptor drum 2 and the property of the motor 33 so that the photoreceptor drum is rotated at a high efficiency and with high rotation precision. In this example, the reduction ratio between the motor gear 34 and the drum driving gear 32 is 1:20.

A rotary encoder 35 is provided on the motor shaft of the driving motor 33 to detect the rotation condition of the driving motor 33. The detection result (signal) is fed back to a motor driving circuit 36 for the driving motor 33 via a controller 37 to control the rotation speed of the driving motor 33 to be the targeted rotation speed. By using a motor including therein a speed sensor and an encoder, it is unnecessary to provide the rotary encoder 35. Specific examples of speed sensors to be included in a motor include print coil type frequency generators (FGs), etc. Specific examples of encoders to be included in a motor includes MR sensors, etc.

The motor driving circuit 36 output a driving current to the driving motor 33. The rotary encoder 35 detects the rotation angular speed (or rotation angular displacement), and outputs the detection result to the controller 37. In this example, the driving motor 33 is a DC servo motor which is a DC brushless motor. This DC servo motor has a U-V-W three phase star-wired coil, a rotor, and three hall elements configured to detect the magnetic pole of the rotor. The output terminals thereof are connected with the motor driving circuit 36. When a DC servo motor including a MR sensor therein includes a rotation speed detecting device (i.e., a speed information detecting device), which includes a magnetic pattern formed on the peripheral surface of the rotor and the MR sensor, is used, the output terminals thereof are connected with the controller 37. The motor driving circuit 36 includes three high side transistors and three low side transistors, which are connected with the U, V and W terminals. The motor driving circuit 36 determines the position of the rotor on the basis of the rotor position signal generated by the hall elements, and generates phase switching signal. The transistors of the motor driving circuit 36 are subjected to an on-off controlling by the phase switching signal, and thereby the three phases are alternately excited, resulting in rotation of the rotor.

The controller 37 compares the rotation speed information, which is obtained by the rotary encoder 35 (or the rotation speed detecting device in a case of encoder with a MR sensor), with the targeted rotation speed information, and generates and outputs a PWM signal to control the rotation speed of the motor shaft to be the targeted rotation speed. The PWM signal is subjected to an AND operation at an AND gate with the phase switching signal from the motor driving circuit 36 to perform chopping of the driving current, resulting controlling of the rotation speed of the driving motor 33.

The controller 37 typically includes a known PLL controlling circuit which compares the phase and frequency of the pulse signal output by the rotary encoder 35 (or the rotation speed detecting device) with those of the pulse signal output by a control target outputting section 38. The control target outputting section 38 outputs a frequency-modulated pulse signal according to the target rotation speed to correct the rotation speed variation per one revolution of the photoreceptor drum 2.

The controller 37 may be a digital circuit instead of an analogue circuit. When digital processing is performed, the cycle of the waveform of the signal output by the rotary encoder 35 (or the rotation speed detecting device) is measured to determine the rotation angular speed. Alternatively, the number of the pulses output by the rotary encoder 35 (or the rotation speed detecting device) per a unit time may be counted to determine the rotation angular speed. When the rotation angular displacement is controlled instead of the rotation angular speed, the number of the pulses output by the rotary encoder 35 (or the rotation speed detecting device) per a unit time is counted to determine the amount of displacement of rotation angle. Then the difference between the data and the target data output by the control target outputting section 38 is determined, and the driving motor 33 is controlled so that the difference is minimized. In general, a PID controller is typically incorporated in the controller 37 so that a PWM signal is output to the motor driving circuit 36 to rotate the photoreceptor drum at the targeted rotation speed without deviation, overshoot, and oscillation.

Then the controlling of rotation of the photoreceptor drum will be explained.

In this example, a DC servo motor, which is a DC brushless motor, is used as the driving motor 33 for driving the corresponding photoreceptor drum 2. When the photoreceptor drum is driven to rotate, the two factors mentioned below influences variation in moving speed of the surface of the photoreceptor drum, which causes the misalignment problem in that monochrome images on the photoreceptor drums are transferred to the intermediate transfer belt while misaligned. Specifically, one of the factors is such that the rotation of the motor varies due to torque ripple of the motor, and thereby the rotation angular speed of the photoreceptor drum is varied, resulting in variation of the moving speed of surface of the photoreceptor drum. In this case, the position of the image formed on the intermediate transfer belt is deviated from the targeted position in the belt moving direction (i.e., the sub-scanning direction). The other of the factors is such that the rotation angular speed of the photoreceptor drum 2 is varied due to cumulative pitch errors of the gears of the drum driving device and/or eccentricity of the rotation shaft of the drum driving gear 32, and thereby the moving speed of the surface of the photoreceptor drum is varied, resulting in deviation of the position of the transferred image from the targeted position.

The variation in moving speed of the surface of the photoreceptor drum 2 caused by the first factor can be fully corrected by the above-mentioned feedback control using the detection result of the rotary encoder 35.

The variation in moving speed of the surface of the photoreceptor drum 2 caused by the second factor can be corrected by a method in which the variation in moving speed (hereinafter sometimes referred to as speed variation profile) of the photoreceptor drum per one revolution thereof is determined on the basis of the result of detection of the detection pattern images, and then the rotation angular speed of the driving motor 33 is controlled on the basis of the speed variation profile. This method will be explained later.

Next, the method for detecting the patterns for use in transfer position adjustment will be explained.

FIG. 3 is a schematic view illustrating the pattern detection mechanism for detecting transfer position adjustment pattern images 44 formed on the intermediate transfer belt 10 by the image forming units 1. For explanation purpose, the positions of the photoreceptor drum 2 and the pattern sensor 40 in FIG. 3 are changed from the positions in FIG. 1. In addition, the form of the intermediate transfer belt 10 illustrated in FIG. 3 is changed from the form in FIG. 1.

The pattern sensor 40 is provided so as to face both end portions of the image forming area of the intermediate transfer belt 10 in the width direction thereof, and has a light emitting diode (LED) 41 configured to irradiate the pattern images, a photo receiver 42 configured to receive reflection light, and a pair of condenser lenses 43. The LED 41 irradiate light having a light quantity sufficient for the photo receiver 42 to detect reflection light from the transfer position adjustment patterns 44. The photo receiver 42 is located to receive the reflection light, which is reflected from the transfer position adjustment pattern images 44 and passes the condenser lenses 43, and is a charge coupled device (CCD), which is a line photo receiver in which the number of photo receiving elements are linearly arranged.

By thus arranging the pattern sensors 40 on both end portions of the image forming area of the intermediate transfer belt 10 in the width direction thereof, registration adjustments in the main scanning direction (i.e., the direction perpendicular to the belt moving direction) and the sub-scanning direction (i.e., the belt moving direction), adjustment of magnification error in the main scanning direction, and adjustment of slope of scanning lines in the main scanning direction can be performed.

Figure 4:
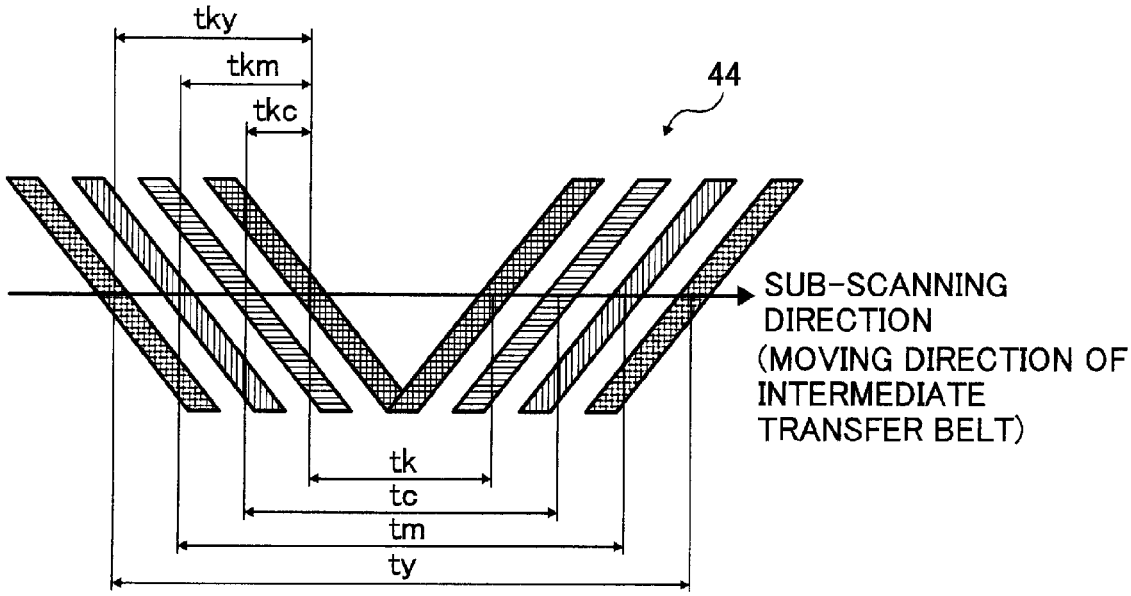
FIG. 4 is a schematic view illustrating an example of the transfer position adjustment detection pattern images.

FIG. 4 is a schematic view illustrating an example of the transfer position adjustment pattern image 44. As illustrated in FIG. 4, the transfer position adjustment pattern image 44 is so-called Chevron patch and includes black, cyan, magenta and yellow line images which are slanted by about 45° against the sub-scanning direction and which are arranged at predetermined intervals. As illustrated in FIG. 3, the transfer position adjustment pattern image 44 is formed on both end portions of the image forming area of the intermediate transfer belt 10 in the width direction thereof. By reading the transfer position adjustment pattern image 44 with the pattern sensor 40, the differences between the detection times of the black image (i.e., the reference image) and each of the other color images is detected. Specifically, by reading the yellow, magenta, cyan, black, black, cyan, magenta and yellow color line patterns (in the direction of from the left side to the right side in FIG. 4), the time difference (tky) in detection time between the black pattern and the yellow pattern, the time difference (tkm) in detection time between the black pattern and the magenta pattern, and the time difference (tkc) in detection time between the black pattern and the cyan pattern are determined. By determining the differences between the time differences (tky, tkm and tkc) with the respective targeted time differences, variation in registration of each of the yellow, magenta and cyan color patterns relative to the black pattern in the sub-scanning direction is determined. Similarly, the time difference (tk) in detection time between the two black pattern images having different slanting angles, the time difference (tc) in detection time between the two cyan pattern images having different slanting angles, the time difference (tm) in detection time between the two magenta pattern images having different slanting angles, and the time difference (ty) in detection time between the two yellow pattern images having different slanting angles, are determined. By determining the differences between the time differences (tk, tc, tm and ty) with the respective targeted time differences, variation in registration of the black, cyan, magenta, and yellow color patterns in the main scanning direction is determined.

The slope of scanning lines can be determined by the difference in registration in the sub-scanning direction between one of the pattern images formed on one side of the intermediate transfer belt 10 and the corresponding pattern image formed on the other side of the intermediate transfer belt. On the basis of the thus determined registration difference, the slope of scanning lines is adjusted by driving the slope adjusting device for adjusting a toroidal lens of the light irradiating device 15.

The method for adjusting the registration in the sub-scanning direction is as follows. At first, variation in registration in the sub-scanning direction is determined on the basis of the average of the detection data of the pattern images. Then the start point of every one scanning line (formed by one surface of the polygon mirror) in the sub-scanning direction is adjusted so that adjacent two start points have a predetermined interval. Alternatively, the average rotation angular speed of the driving motor 33 for driving the photoreceptor drum 2 may be adjusted to adjust the time period in which a point of the surface of the photoreceptor drum on the image writing position is moved to the image transfer position.

Figure 5:
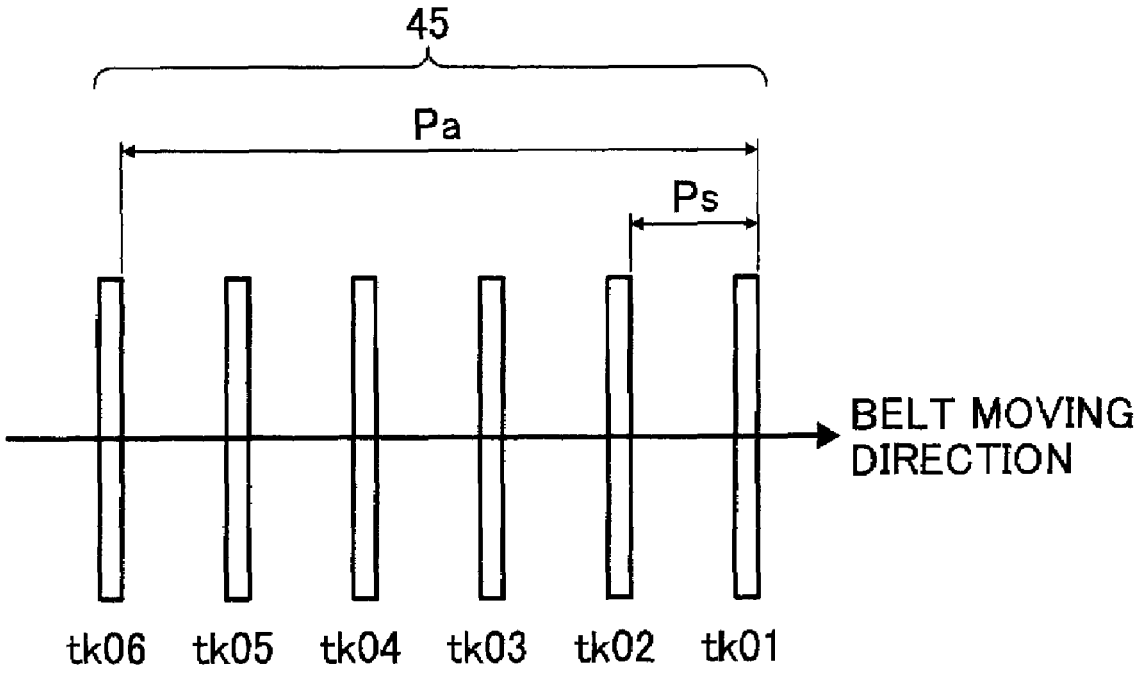
FIG. 5 is a schematic view illustrating the detection pattern images for use in reducing the variation in moving speed of the image bearing member.

FIG. 5 is a schematic view illustrating a pattern image 45 used for detecting the variation in moving speed of the surface of the photoreceptor drum caused by the above-mentioned second factor.

The pattern image 45 includes line pattern images of one of the color toners K, C, M and Y (in FIG. 5, the black (K) toner is used), which are longer in the main scanning direction and which are arranged at regular interval (Ps) in the sub-scanning direction. The line pattern images are detected by the pattern sensor 40 in order of formation of the line pattern images (i.e., in the order of tk01, tk02, tk03, tk04, tk05 and tk06) to determine the detection time of the line patterns tk01, tk02, tk03, tk04, tk05 and tk06 relative to a reference time. This operation is performed while changing the toner. By forming such line pattern images on both sides of the intermediate transfer belt 10, two different color pattern images can be detected at the same time. Namely, by performing this operation twice, detection of four different color pattern images can be completed, resulting in shortening of the detection time. In addition, since the line pattern images 45 are formed of a single color toner, the interval between two adjacent pattern images can be extremely shortened and therefore high-precision detection can be performed.

Figure 6:
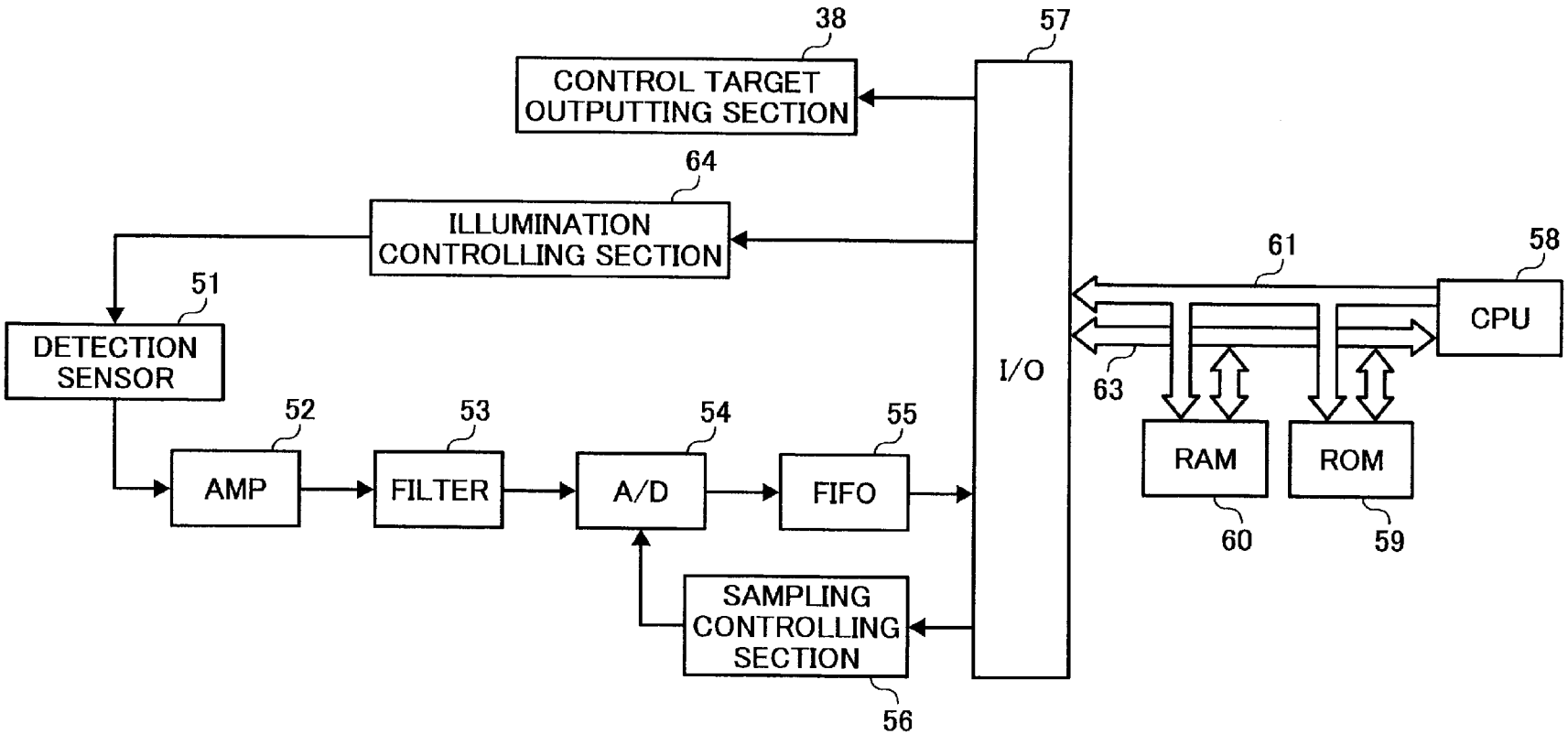
FIG. 6 is a block diagram illustrating the drum driving device.

FIG. 6 is a block diagram illustrating the electrical configuration of the drum driving device.

The signal including the information obtained by the pattern sensor 40 (illustrated in FIG. 3) included in a detection sensor 51 is amplified by an amplifier (AMP) 52, and only the signal components of the transfer position adjustment pattern image 44 (illustrated in FIG. 4) and the detection pattern 45 (illustrated in FIG. 5) pass a filter 53. After passing the filter 53, the signal is converted from analogue data to digital data by an A/D converter 54. The data are stored in a First-In-First-Out (FIFO) memory 55. After the detection of the detection pattern image 45 is completed, the stored data are loaded into a CPU 58 and a RAM 60 by a data bus 63 via an I/O port 57. The CPU 58 performs an arithmetic processing to determine the above-mentioned variations.

At first, the CPU 58 changes the setup conditions for the driving of the stepping motor (not shown) for driving the intermediate transfer belt and writing conditions on the basis of the correction data determined according to the detection signal of the transfer position adjustment pattern image 44 to perform correction of skew, change of registration in the main scanning direction, change of registration in the sub-scanning direction, and change of image frequency which is changed due to magnification error. Controlling of writing conditions can be performed by controlling the registrations in the main and sub-scanning directions. In addition, a clock generator using a device capable of setting the output frequency in detail (such as voltage controlled oscillators) is provided for each of the four image forming units. In the image forming apparatus of the present invention, output from the clock generator is used as the image clock.

In this example, on the basis of the correction determined according to the detection signal of the detection pattern image 45 to correct the driving conditions of the driving motor so that the variation in position per one revolution of the photoreceptor drum is minimized. The corrected driving conditions are set as the target in the control target outputting section 38. The control target outputting section 38 outputs a signal of the rotation speed target (digital data or pulse train signal) to the controller 37 (illustrated in FIG. 2) of each photoreceptor drum 2.

The CPU 58 monitors the detection signal from the detection sensor 51 at proper timing. The light quantity of light emitted by the LED 41 is controlled to be constant by an illumination controlling section 64 so that the detection sensor 51 can securely detect the detection pattern image 45 even when the intermediate transfer belt 10 and the LED 41 of the detection sensor 51 deteriorate. Therefore, the light quantity of light received by the photo receiver 42 of the detection sensor 51 is controlled to be always constant.

A ROM 59 stores various kinds of programs such as program for calculating the variation data mentioned above. An address bus 61 performs designation of ROM address, RAM address and input/output devices.

Then the feature of the present invention, i.e., how to reduce variation in moving speed of the photoreceptor drum caused by the second factor, will be explained.

In this example, the detection pattern image 45 illustrated in FIG. 5 is used for reducing variation in moving speed of the photoreceptor drum caused by the second factor. As illustrated in FIG. 5, a number of line patterns of each color toner (for example, line patterns are continuously formed on the photoreceptor drum during the drum is rotated by several revolutions) are formed on the intermediate transfer belt 10 at regular intervals in the moving direction of the intermediate transfer belt. The reason why monochrome line patterns are formed is to prevent the line pattern images from being damaged when plural different color pattern images are overlaid, i.e., to perform high-precision pattern detection. When such a problem is not caused, line patterns of K, Y, M and C toners may be alternately formed at regular intervals.

In FIG. 5, a pattern length Pa of the sampled line pattern images is preferably not less than half the peripheral length of the photoreceptor drum 2. More preferably, the pattern length Pa is several times the peripheral length of the photoreceptor drum 2. When the pattern length Pa is determined, periodical rotation variations other than the periodical rotation variation of the photoreceptor drums, which influence the position of the pattern images, have to be considered. Specific examples of such periodical rotation variations include variation in rotation of the driving motor of the intermediate transfer belt, variation in pitch and eccentricity of the gears of the driving motor, meandering of the intermediate transfer belt, variation in thickness of the intermediate transfer belt, etc. These variations have different frequencies. The detected data include variations such that the frequencies thereof are superimposed. Therefore, it is necessary to precisely extract the speed variation profile per one revolution of the photoreceptor drum from the data including such variations. The line pattern images 45 are formed at a predetermined interval Ps. In order to perform high-precision detection, the interval Ps is as short as possible, i.e., dense line patterns have to be formed. The interval Ps is determined in consideration of the resolution of the image forming apparatus and the time needed for calculation.

Let's assume a case where variation in rotation of the photoreceptor per one revolution thereof and variation in rotation cycle of the driving roller 8 largely influence the variation in position of the pattern image 45. In such a case, the pattern length Pa of the sampled line patterns is determined in consideration of the rotation cycle of the driving roller 8. Specifically, when the diameter of the photoreceptor drum 2 is 40 mm and the diameter of the driving roller 8 is 30 mm, the rotation cycles of the photoreceptor drum 2 and the driving roller 8 are 125.7 mm and 94.2 mm, respectively, on the intermediate transfer belt. The pattern length Pa is preferably set to a length which is a multiple number of both the rotation cycles. Specifically, the pattern length Pa is preferably set to 377 mm, which is a least common multiple of 125.7 mm and 94.2 mm.

The interval Ps is determined on the basis of the pattern length Pa. By using this method, the speed variation profile of the photoreceptor per one revolution thereof (which is mentioned later) can be determined with high precision without being influenced by the variation of the driving roller 8. Specifically, when the speed variation profile of the photoreceptor drum is determined, plural calculation results are averaged to negate the variation of the driving motor 8. Similarly, when it is necessary to consider the variation in rotation of the intermediate transfer belt caused by uneven thickness of the intermediate transfer belt, the pattern length Pa is preferably set to a length which is around the peripheral length of the intermediate transfer belt and which is a multiple number of the peripheral length of the photoreceptor drum to reduce the influence of the variation in rotation of the intermediate transfer belt.

Variation components having a cycle of not greater than one tenth of the cycle of the photoreceptor drum, such as variation in rotation of the motor for driving the driving roller 8, can be removed by a low-pass filter in the digital processing of the detection data.

It is preferable to perform feedback controlling on the intermediate transfer belt driving system because the variation in rotation of the photoreceptor drum per one revolution thereof can be determined with high precision. For example, a rotary encoder is provided on the rotation shaft of the support roller 12, which is rotated while supporting the intermediate transfer belt 10. On the basis of the rotation information obtained by the rotary encoder, the rotation of a motor (not shown) driving the intermediate transfer belt is controlled so that the output from the rotary encoder (i.e., the rotation angular speed) becomes constant. By using this method, variation in rotation of the intermediate transfer belt caused by errors of the driving roller 8 and the drive transmission system, and slip between the driving roller 8 and the backside of the intermediate transfer belt 10 can be dramatically reduced. Therefore, among the variations mentioned above, only the variation in rotation of the support roller 12, which is caused by eccentricity of the support roller itself and eccentricity thereof caused by setting of the encoder, remains. Therefore, the pattern length Pa of the sampled patterns is preferably set to a multiple number of both the cycles of the photoreceptor drum 2 and the support roller 12 to perform detection with high precision.

In this example, not only deterioration of images caused by the initial positional variation but also deterioration of images caused by additional positional variation which is caused by deterioration of parts after repeated use can be avoided.

Specifically, in the image forming apparatus, the positions and sizes of the image forming units themselves and the positions and sizes of the parts constituting the image forming units are changed when the temperature of the image forming apparatus changes and an external force is applied to the image forming apparatus. These changes are unavoidable. For example, when a jammed receiving material sheet is removed from the image forming apparatus, parts are replaced in a maintenance operation, and/or the image forming apparatus is moved from a position to another position, an external force is applied to the image forming apparatus. When the internal temperature of the image forming apparatus changes and/or an external force is applied thereto (i.e., additional variation factors are generated), alignment of images formed by the image forming units deteriorates, resulting in deterioration of image qualities.

The image forming apparatus performs an operation of sampling the detection pattern image 45 and a correction operation at a time after the apparatus is turned on or the image forming apparatus is returned to an image forming operation state, for example, after removing a jammed receiving material, or at a predetermined time. The sampling and correction operations are performed-before an image forming operation or at a time between image forming operations.

In this example, the sampling and correction operations are performed once just after the apparatus is turned on (or a maintenance operation is performed). This is because the variation in position occurring at a cycle of one revolution of the photoreceptor drum is caused by the variation of parts (such as the drive transmission gears and coupling) and variation in assembling the parts. Namely, such variations are hardly influenced by change of environmental conditions and the period of service during which the parts have been used, and therefore it is not necessary to frequently perform the sampling and correction operations. The sampling and correction operations using the detection pattern image 45 are preferably performed after the sampling and correction operations using the detection pattern image 44 to improve the precision in detection of the pattern 45.

The sampling and correction operations using the detection pattern 45 are performed as follows.

At a predetermined timing, for example, a time when the mark 4 (illustrated in FIG. 1) is detected by the drum position sensor 20, the CPU 58 (illustrated in FIG. 6) issues an order so that images of the detection pattern 45, information of which is stored in the ROM 59, are formed on the respective photoreceptor drums 2Y, 2C, 2M and 2K. Then the image forming units 1 form detection pattern images 45 on the respective photoreceptor drums according to the image data, and sequentially transfer the pattern images to the intermediate transfer belt 10, resulting in formation of the group of pattern images on the intermediate transfer belt. The detection sensor 51 detects the thus formed detection pattern images. The detection results are sampled at an interval set in a sampling controlling section 56, followed by A/D conversion by the A/D converter 54, resulting in formation of discrete data. The discrete data are stored in the FIFO 55. The data stored in the FIFO 55 are the output signals, which are output from the photo receiving element depending on the quantity of the light reflected from the detection pattern images and which change depending on the color of the toner constituting the pattern images and the image density of the pattern image (toner image).

It is preferable in this example that passing of the detection pattern images is timely detected by the detection sensor with high precision. Detection of the pattern images is not performed by pattern detection using a threshold, and is performed by peak recognition. Therefore, variation in position can be precisely detected, which is a feature of this example. The reason why the peak recognition is better is that the detection is hardly influenced by damage of the detection pattern images due to variation in moving speed of the photoreceptor drums. The details of the reason will be explained below.

Figure 7A:
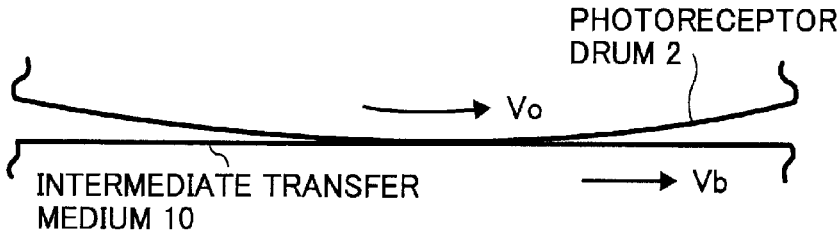
FIG. 7 includes schematic views illustrating the image density of the detection pattern images formed on the photoreceptor drum and the intermediate transfer medium when the rotation speed of the image bearing member varies.
Figure 7B:
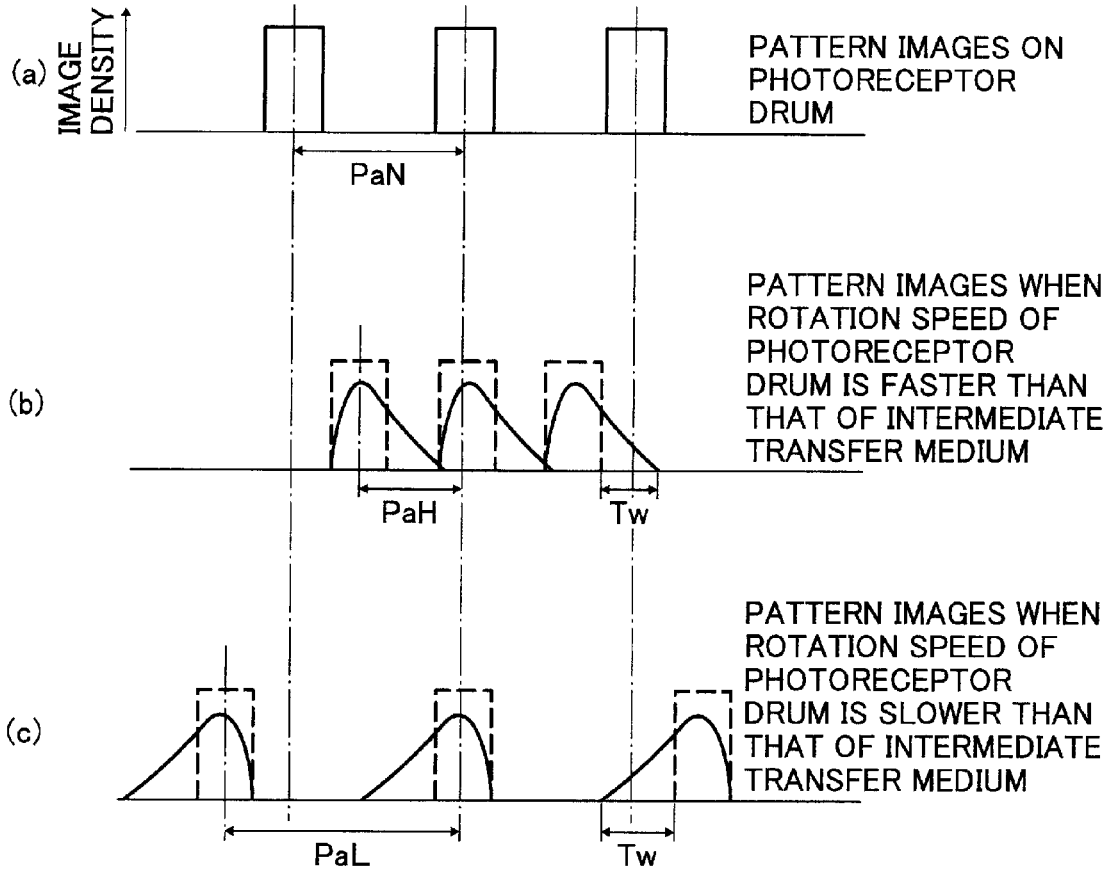

FIG. 7A is a schematic view illustrating the image transfer region at which the photoreceptor drum 2 and the intermediate transfer belt 10 are contacted with each other. FIG. 7B is a schematic view illustrating image densities of the detection pattern images 45.

As illustrated in FIG. 7A, the photoreceptor drum 2 and the intermediate transfer belt 10 independently move at speeds of Vo and Vb, respectively, while being contacted with each other and slipping due to toner particles and a lubricant present on the photoreceptor drum and/or the intermediate transfer belt, and/or a lubricating layer formed on the photoreceptor drum and/or the intermediate transfer belt. In FIG. 7B-(a), (b) and (c), the distance between the detection pattern images formed on the intermediate transfer belt is plotted on the horizontal axis, and the image density of the detection pattern images (i.e., toner images) formed on the intermediate transfer belt is plotted on the vertical axis. In this example, pattern images with a predetermined image density are formed on the photoreceptor drum at predetermined intervals PaN as illustrated in FIG. 7B-(a).

When the moving speed Vo of the photoreceptor drum 2 is higher than the moving speed Vb of the intermediate transfer belt 10 (i.e., Vo>Vb), the detection pattern images transferred on the intermediate transfer belt have a cross section as illustrated in FIG. 7B-(b). In this case, the photoreceptor drum 2 outruns the intermediate transfer belt 10 at the image transfer region, and thereby pattern images are formed at an interval of PaH, which is shorter than an interval PaN of the pattern images on the photoreceptor drum. An extended portion having a length of Tw is formed on one side of the pattern images due to collapse of the pattern images caused by the different moving speeds (Vo and Vb). This is because the image transfer region has a nip length of about 2 mm in the moving direction of the photoreceptor drum and thereby the pattern images (i.e., toner images) are transferred while rubbed, resulting in collapse of the toner images.

In contrast, when the moving speed Vo of the photoreceptor drum 2 is lower than the moving speed Vb of the intermediate transfer belt 10 (i.e., Vo<Vb), the detection pattern images transferred on the intermediate transfer belt have a cross section as illustrated in FIG. 7B-(c). In this case, pattern images are formed at an interval of PaL, which is longer than the interval PaN of the pattern images on the photoreceptor drum. In addition, similarly to the pattern images illustrated in FIG. 7B-(b), an extended portion having a length of Tw is formed on the opposite side of the pattern images due to collapse of the pattern images caused by the different moving speeds (Vo and Vb).

It is preferable in this example to precisely detect the interval (PaH and PaL), which changes depending on the variation of the photoreceptor drum 2. As mentioned above, when the moving speed of the photoreceptor drum 2 is periodically changes, the difference in moving speed between the photoreceptor drum and the intermediate transfer belt also changes periodically, and thereby the length Tw also changes periodically.

When a conventional detection method detecting the edge of a pattern image using a predetermined threshold is used, a problem in that the edges of the pattern images cannot be well detected due to collapse of the pattern images and another problem in that the image density of a collapsed pattern image does not exceed the threshold occur.

In this example, the peak of a pattern image is used for the pattern detection timing. Specifically, the CPU 58 determines the peaks of the image densities of pattern images from the signal data, which are stored in the FIFO 55 at a predetermined sampling cycle and which have a high correlation with the image densities of the pattern images. The thus obtained timing data are stored in a RAM 60. Therefore, the pattern interval (PaH and PaL) can be determined with high precision.

The thus determined pattern interval data (hereinafter sometimes referred to as the pattern detection data) is stored in the RAM 60. This pattern detection data have a variation component with a cycle corresponding to the revolution of the photoreceptor drum 2. In this example, other variation components than the variation component are removed from the pattern detection data to obtain the variation component of the photoreceptor drum (i.e., the variation profile).

The above-mentioned pattern detection data are data including information on the times (tk01, tk02, tk03, . . . ) from a reference time, at which the pattern images are detected. Therefore, the pattern detection data are a group of data, which increase in a monotonic manner while being superimposed with variation components. Therefore, a component increasing the pattern detection data (i.e., the slope of the curve of the data) has to be removed therefrom. The slope can be determined from the curve of the data by using a least squares method. The slope is used for magnification correction.

Periodical variations other than the periodical variation of the photoreceptor drum, which have a higher cycle (by about ten or more times) than the periodical variation of the photoreceptor drum, can be removed by a low pass filter (LPF). In this example, the cycle of rotation of the photoreceptor drum is on the order of a few Hz although the cycle varies depending on the image forming modes. Therefore, a LPF with a cut-off frequency of tens of cycles per second (Hz) is used. By using such a LPF, variation components with a high frequency, such as periodical variations caused by combined gears and motors, can be removed from the pattern detection data. Therefore, only the signal including the low-frequency variation component caused by periodical variation in rotation of the photoreceptor drum can be extracted.

On the basis of the thus determined variation profile of the photoreceptor drumper one revolution, the CPU 58 calculates the drive control correction value, and sends the drive control correction value to the control target outputting section 38. According to this drive control correction value, the rotation of each of the photoreceptor drums is adjusted such that the variation caused by periodical variation in rotation of the photoreceptor drum is negated. Specifically, when it is detected that the moving speed of the photoreceptor drum is fast and thereby pattern images with a short pattern interval PaH are detected, the speed for driving the photoreceptor drum is adjusted so as to be slow. In contrast, when it is detected that the moving speed of the photoreceptor drum is slow and thereby pattern images with a long pattern interval PaL are detected, the speed for driving the photoreceptor drum is adjusted so as to be fast.

Figure 8:
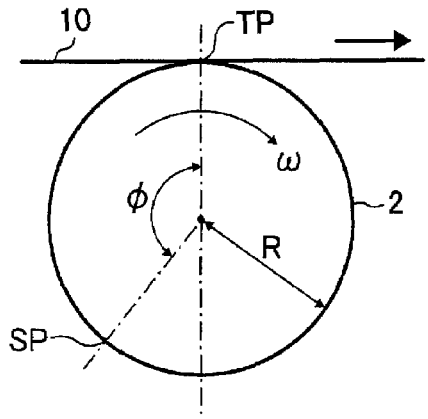
FIG. 8 is a schematic view for explaining the phase difference $\phi$.

The variation profile of the photoreceptor drum per one revolution thereof thus determined by the pattern variation data mentioned above includes the variation in moving speed of the photoreceptor drum at the image writing position SP (in FIG. 8) and the variation in moving speed of the photoreceptor drum at the image transfer position TP (in FIG. 8). These two variations are superimposed and the superimposed variations are detected as the variation of the interval of the pattern images.

In a case where the angle between the image writing position SP on the photoreceptor drum 2 and the image transfer position TP thereon is $\phi$ as illustrated in FIG. 8, the method for determining the drive control correction value on the basis of the pattern variation data mentioned above will be explained below.

At first, starting from a reference time when the drum position sensor 20 detects the mark 4 (illustrated in FIG. 1), latent images of the detection pattern images start to be formed on the image writing position SP at predetermined intervals. In this regard, the photoreceptor drum has a rotation angular speed ω, which is represented by the following equation (1).

$$\omega=\omega_o+f(\omega_o t_o+\alpha) \tag{1}$$

In equation (1), the second term $f(\omega_o t_o+\alpha)$ represents variation in rotation angular speed, which has the same cycle as that of rotation of the photoreceptor drum per one revolution thereof, at a time $t_o$ after the reference time when the drum position sensor 20 detects the mark 4. Specifically, the rotation variation is mainly caused by eccentricity, etc., of the drum driving gear 32 provided on the shaft of the photoreceptor drum 2. In addition, α represents the phase of the periodical variation determined on the basis of the time when the drum position sensor 20 detects the mark 4. In this case, the moving speed $V_{sp}$ of the surface of the photoreceptor drum 2 is represented by the following equation (2).

$$V_{sp}=R\{\omega_o+f(\omega_o t_o+\alpha)\} \tag{2}$$

wherein R represents the radius of the photoreceptor drum.

In addition, the interval $\delta P_o$ between two adjacent detection pattern images formed at the image writing position SP for a predetermined minute time period δt is represented by the following equation (3).

$$\delta P_o=V_{sp}\delta t=R\{\omega_o+f(\omega_o t_o+\alpha)\}\delta t \tag{3}$$

These detection pattern images are transferred onto the intermediate transfer belt at a time Tϕ after formation of the pattern images, wherein Tϕ is the time taken to rotate the photoreceptor drum by the angle ϕ. As illustrated in FIG. 8, the angle ϕ is defined as an angle formed by a line connecting the image writing position SP with the center of the photoreceptor drum and a line connecting the image transfer position TP with the center of the photoreceptor drum.

The angular speed $\omega_\phi$ of the photoreceptor drum at the time when the detection pattern images are transferred onto the intermediate transfer belt is represented by the following equation (4).

$$\omega_\phi=\omega_o+f(\omega_o t_o+\alpha+\phi) \tag{4}$$

In equation (4), the second term $f(\omega_o t_o+\alpha+\phi)$ represents the variation component of the photoreceptor drum per one revolution thereof when the detection pattern images are transferred. Therefore, the phase difference is ϕ at a time Tϕ after formation of the latent image at the image writing position SP. In this case, the moving speed $V_{TR}$ of the surface of the photoreceptor drum 2 is represented by the following equation (5).

$$V_{TR}=R\{\omega_o+f(\omega_o t_o+\alpha+\phi)\} \tag{5}$$

When the moving speed of the surface of the intermediate transfer belt 10 is equal to that of the photoreceptor drum 2, $V_b=R\omega_o$. When the moving speed of the surface of the photoreceptor drum is faster (slower) than that of the intermediate transfer belt, the intervals between two adjacent pattern images on the intermediate transfer belt are longer (shorter) than the intervals between two adjacent pattern images on the photoreceptor drum. Therefore, the intervals δ P between two adjacent pattern images on the intermediate transfer belt is represented by the following equation (6).

$$\delta_P=\delta P_o\cdot V_b/V_{TR}=P_n\{\omega_o+f(\omega_o t_o+\alpha)\}/\{\omega_o+f(\omega_o t_o+\alpha+\phi)\} \tag{6}$$

wherein $P_n=R\omega_o\delta t$.

Equation (6) is an equation assuming that the detection pattern images are transferred while the photoreceptor drum and the intermediate transfer belt are slipped at the image transfer position TP (this transfer is hereinafter sometimes referred to as slip transfer). However, it is possible that the detection pattern images are transferred while the photoreceptor drum and the intermediate transfer belt are rotated at the same speed and are tacked to each other (this transfer is hereinafter sometimes referred to as tack transfer). When tack transfer is performed, the transfer position of the pattern images does not vary because even when the moving speed of the photoreceptor drum varies, the intermediate transfer belt moves at the same speed as that of the photoreceptor drum. Therefore, the interval between the transferred detection pattern images largely changes depending on the transfer mechanism (i.e., whether slip transfer or tack transfer is performed).

Therefore, a transfer coefficient k is introduced to equation (6). When k=1, slip transfer is performed. In contrast, when k=0, tack transfer is performed. In reality, detection pattern images are transferred while slip transfer and tack transfer are combined. Specifically, the image transfer process changes depending on the transfer conditions such as transfer bias, properties of the toner used, and properties and applied amount of the lubricant. Therefore, k is a number between 0 and 1, and equation (6) is changed to the following equation (7).

$$\delta P=\delta P_o\cdot V_b/V_{TR}=P_n\{\omega_o+f(\omega_o t_o+\alpha)\}/\{\omega_o+kf(\omega_o t_o+\alpha+\phi)\} \tag{7}$$

Since the variation component f is much smaller than the average angular speed $\omega_o$, the following approximate equation (8) can be used.

$$\delta P=P_n(1/\omega_o)\{\omega_o+f(\omega_o t_o+\alpha)-kf(\omega_o t_o+\alpha+\phi)\} \tag{8}$$

Equation (8) represents the interval between two adjacent pattern images transferred onto the intermediate transfer belt for the predetermined minute time period δt.

When latent detection pattern images are formed in the image forming apparatus, latent detection pattern images are formed at the image writing position SP for a predetermined time period Te which is different from the predetermined minute time period δt. The latent images are developed and the resultant toner images are transferred onto the intermediate transfer belt. The thus formed detection pattern images are detected by the photo receiver 42 to determine the passing time (i.e., the pattern detection time). In these operations, the time when the drum position sensor 20 detects the mark 4 is used as the reference time. The position of the intermediate transfer belt where the first pattern image formed at the reference time is detected by the photo receiver 42 is hereinafter referred to as a reference point (O). In this case, the interval $P_N$ between the first pattern image and the N-th detection pattern image which is the last image of the pattern images formed during the time TeN (N is a natural number) is represented by the following equation (9).

$$\begin{aligned} P_N &= \int_0^{TeN} \delta P dt_0 \\ &= \int_0^{TeN} R\{\omega_0 + f(\omega_0 t_0 + \alpha) - \kappa f(\omega_0 t_0 + \alpha + \phi)\} dt_0 \end{aligned} \tag{9}$$

From equation (9), the following equation (10) is derived.

$$P_N=R\omega_o TeN+RF(\omega_o t_o+\alpha)-kRF(\omega_o t_o+\alpha+\phi)+C \quad (10)$$

In equation (10), F represents a function obtained by integrating a periodic function f, and C represents an integration constant.

The group of detection pattern images thus formed on the intermediate transfer belt for the predetermined time Te have the interval represented by equation (10). The interval of the pattern images are detected by the photo receiver. The above-mentioned pattern image detection data (data having units of time) stored in the RAM 60 are converted to information concerning the position of the detection pattern images on the intermediate transfer belt using the information concerning the moving speed of the surface of the intermediate transfer belt. In equation (10), $R\omega_o TeN$ represents the slope of the curve of the pattern image detection data, and is used for detection of magnification error. The pattern image variation data are subjected to the above-mentioned filtering treatment to determine the variation component (variation profile) of the photoreceptor per one revolution. This variation component is equal to the second and third terms of equation (10), i.e., $(RF(\omega_o t_o+\alpha)-kRF(\omega_o t_o+\alpha+\phi))$. The integration constant C in equation (10) is a steady-state deviation, and does not influence the variation components determined after the filtering treatment.

The variation component of the photoreceptor drum per one revolution, which can be obtained by removing the first term (representing the slope of the pattern image detection data) and the fourth term (representing the steady-state deviation) from equation (10), is represented by the following equation (11).

$$P_{N_F}=RF(\omega_o t_o+\alpha)-kRF(\omega_o t_o+\alpha+\phi) \quad (11)$$

This is caused by the variation in rotation angular speed of the photoreceptor drum represented by the second term of equation (1). However, the thus obtained variation component includes both the variation in rotation angular speed of the photoreceptor drum at the time when the images are written on the photoreceptor (i.e., the first term of equation (11)), and the variation in rotation angular speed of the intermediate transfer belt at the time when the images are transferred (i.e., the second term of equation (11)), wherein the variations are suprimposed.

In order to determine the drive control correction value for correcting the variation in rotation angular speed of the photoreceptor drum, at first the variation component of the photoreceptor drum per one revolution thereof, which is represented by equation (11), is calculated. Then the first term or the second term of equation (11) is extracted from the variation component. Since the thus extracted function F represents the variation in rotation angle of the photoreceptor drum per one revolution, a value negating such variation is calculated. In this regard, the function F representing the variation in rotation angle or the function f, which represents the variation in rotation angular speed and which can be obtained by differentiating the function F can be used as the drive control correction value.

Next, the method of extracting only the first term or the second term from the variation component after filtering represented by equation (11) will be explained. Namely, the method of calculating the function F from the data in which periodic functions F of two photoreceptor drums are superimposed will be explained. For explanation purpose, equation (11) is changed to the following equation (12).

$$P_{N_F}=F(x)-kF(x-\phi') \quad (12)$$

The variation component after filtering represented by equation (12) is a data row per one or plural revolutions of the photoreceptor drum. Plural (n pieces) equations (13) are obtained by delaying the phase of equation (12) by $\phi'$, $2\phi'$, $3\phi'$, . . . , and $(n-1)\phi'$.

$$[1]: F(x)-kF(x-\phi')$$

$$[2]: F(x)-kF(x-\phi')+k\{F(x-\phi')-kF(x-2\phi')\}$$

$$[3]: F(x)-kF(x-\phi')+k\{F(x-\phi')-kF(x-2\phi')\}+k^2\{F(x-2\phi')-kF(x-3\phi')\}$$

$$[n]: F(x)-kF(x-\phi')+\ldots+k^{n-1}\{F(x-(n-1)\phi')-kF(x-n\phi')\} \quad (13)$$

In this regard, the number (n) of data is as many as possible. The optimum number of n will be explained later.

Equation (13)-[1] represents the variation component after filtering. In equation (13)-[2], a variation component which is the same as the variation component [1] except that the phase is delayed by the phase difference $\phi'$ is added to the variation component [1]. In equation (13)-[3], a variation component which is the same as the variation component [1] except that the phase is delayed by $2\phi'$ is added to the variation component [2]. Similarly, in equation (13)-[n], a variation component which is the same as the variation component [1] except that the phase is delayed by $(n-1)\phi'$ is added to the variation component [n−1] Thus, n data rows are prepared. By calculating the data rows, the following plural equations (14) can be obtained.

$$[1]: F(x)-kF(x-\phi')$$

$$[2]: F(x)-k^2F(x-2\phi')$$

$$[3]: F(x)-k^3F(x-3\phi')$$

$$[n]: F(x)-k^nF(x-n\phi') \quad (14)$$

The sum of the data rows is represented by the following equation (15).

$$\text{Sum}=nF(x)-kF(x-\phi')-k^2F(x-2\mathbf{100}')-k^3F(x-3\phi')-\ldots-k^nF(x-n\phi') \quad (15)$$

In this regard, the function F(x) of the first term of equation (15) is multiplied by n. However, the function F(x) of the other terms are different in phase from the function F(x) of the first term while dispersed. In addition, the other terms has a coefficient including the transfer coefficient k. The function F(x) of the first term is relatively large compared to the other terms. By dividing equation (15) by n, the function F(x) can be derived.

$$\text{Sum}/n=F(x)-1/n\{kF(x-\phi')-k^2F(x-2\phi')-k^3F(x-3\phi')-\ldots-k^nF(x-n\phi')\}=F(x) \quad (16)$$

By making such a calculation, the function F(x) can be derived from the variation component after filtering.

Figure 9A:
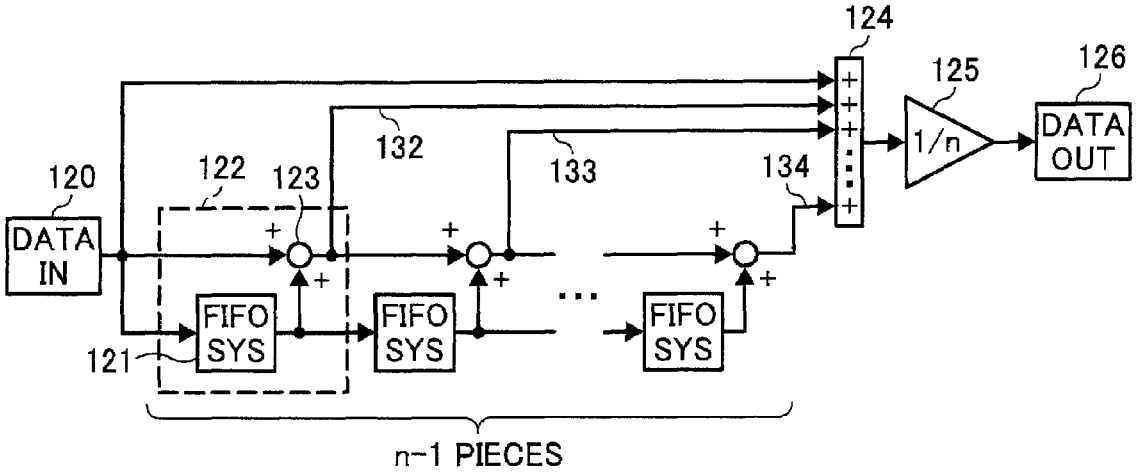
FIG. 9 includes block diagrams illustrating calculation processing for obtaining a function derived from the variation component of the photoreceptor drum.
Figure 9B:
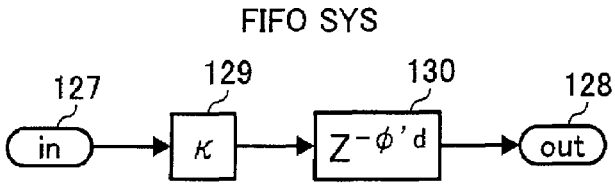

FIG. 9A is a block diagram illustrating the above-mentioned calculation processing. FIG. 9B is a block diagram illustrating the internal processing of a block 121 (including a FIFO and a gain (hereinafter referred to as a FIFO system) illustrated in FIG. 9A.

As illustrated in FIG. 9B, the FIFO system determines a product of an input data 127 and a transfer coefficient k 129. Then a phase delay of rotation angle $\phi'$ is added thereto in a block 130. Specifically, past input data corresponding to the phase delay are output. Since the input data are discrete data, a character Z of an operator representing the Z-transformation is attached. As mentioned above, the input data are data concerning the interval $P_N$ of the N-th detection pattern image which is formed at a time TeN (N is a natural number). The block 130 represents a FIFO memory storing data for the angle $\phi'$. Specifically, data of the pattern toner images (the number of the images is $\phi'$ d wherein d is an integer) formed a surface area of the photoreceptor drum having an angle $\phi'$ at the center of the photoreceptor drum are stored in the FIFO memory. In a block 128 in FIG. 9B, the memory outputs the stored data of ($\phi'$d) pieces of the pattern toner images.

In FIG. 9A, input data 120 are data concerning the variation component after filtering represented by equation (12). The input data 120 are sent to the FIFO system 121, a first adder 123, and a second adder 124. In the FIFO system 121, the above-mentioned delay processing is performed. The first adder 123 adds the input data, which have been subjected to the delay processing, and the original input data. Specifically, the calculation performed by the first adder 123 is the calculation of [2] of equation (13), and a result thereof 132 is equal to [2] of equation (14). In this regard, two or more (i.e., (n−1) pieces) of a system 122, which is illustrated by a dotted line in FIG. 9A and which includes the FIFO system 121 and the first adder 123, are connected in parallel, and the calculation results obtained by the systems are sent to the second adder 124. In this regard, an addition result 133 is equal to [3] of equation (14), and an addition result 134 is equal to [n] of equation (14). The second adder 124 performs the addition calculation of equation (15) and a gain 125 performs the calculation of equation (16). A calculation result 126 is the function $f(x)$ as mentioned above.

Next, the number (n) of the data rows prepared by performing a phase delay by the phase angle $\phi'$ in the FIFO system will be explained. In equation (16), the component (term) F(x) to be determined is added at the same phase. However, terms (such as $F(x-\phi')$) other than the term F(x) are different in phase and are therefore dispersed. By using this property, the component F(x) is determined. Therefore, it is preferable that the terms (such as $F(x-\phi')$) other than the component F(x) are evenly dispersed in the range of one revolution (i.e., $2\pi$) of the photoreceptor drum. Specifically, it is preferable that phase differences ($-\phi'$, $-2\phi'$, $-3\phi'$, . . . , $n\phi'$) are evenly arranged in the range of one revolution ($2\pi$) of the photoreceptor drum. Therefore, the number n preferably satisfies the following equation (17).

$$n\phi' \simeq 2\pi m \tag{17}$$

wherein m is a natural number.

For example, when the phase difference $\phi'$ illustrated in FIG. 1 is 216° (i.e., 3.77 rad), the equation (17) is satisfied if n=10 and m=6. The calculation processing is performed while connecting in parallel nine of the system 122 surrounded by the dotted line in FIG. 9A. Thus, the precision in calculation of the component F(x) can be improved due to the effect of even dispersion of the other terms.

In the above-mentioned example where n =10 and nine of the system 122 are connected in parallel, the total time of the delay processing is $9\phi'$ until the ninth FIFO system outputs data. When data greater than that of the data corresponding to $9\phi'$ are input in a block 120 (Data In) , the last-connected FIFO system output a number. After the processing is performed at the adder 124 and the gain 125, output data 126 can be obtained. By calculating the output data obtained during at least a time when the photoreceptor drum is rotated by one revolution, the variation in rotation angle F (x) of the photoreceptor drum can be determined. Therefore, it is necessary for the Data In 120 to send data obtained during at least a time when the photoreceptor drum is rotated at a rotation angle of ($9\phi' + 2\pi$). The Data In 120 stores data rows concerning variation of the detection pattern images obtained during one or more revolutions of the photoreceptor drum. When the number of the variation data is less than the total of the number of the delay processing and the number of data obtained during one revolution of the photoreceptor drum, the Data In 120 repeatedly sends the stored variation data. By repeatedly sending the variation data, the data obtained during at-least a time when the photoreceptor drum is rotated at a rotation angle of ($9\phi' + 2\pi$) can be input. When the output data 126 in an amount corresponding to the angle $9\phi' + 2\pi$ (i.e. , one revolution of the photoreceptor) are processed, the variation F(x) in rotation angle of the photoreceptor is determined. In a case where variation data obtained during two or more revolutions of the photoreceptor drum are stored in the Data In 120, when the amount of the output data 126 reaches the amount corresponding to the revolutions of the photoreceptor, the data are synchronously added to determine the variation F (x) per one revolution of the photoreceptor drum.

The detection pattern images are formed at the interval Te, and the detection data of the pattern images are obtained. The calculation processing illustrated in FIG. 9A is performed on the data, which are discrete in terms of time. In this case, it is preferable that the adder 123 performs processing while the time when the data are output from the FIFO system after the delay processing and the time when the detection data are input are controlled to be identical to each other, because influence of the error due to discretion of the data in terms of time is little. Therefore, it is preferable that the detection pattern images are arranged within a phase angle corresponding to the rotation angle range of $\phi'$. In addition, even when the data obtained during the photoreceptor drum is rotated by plural revolutions are synchronously added, the error due to discretion of the data in terms of time is little if the detection pattern images are arranged at an equal interval in a length corresponding to the peripheral length of the photoreceptor drum, and thereby the average can be determined. Therefore, it is preferable that the detection is performed at regular intervals within the phase angle range of $\phi'$ and the angle range of one revolution ($2\pi$) of the photoreceptor drum.

Hereinbefore, the method in which the detection pattern images are written starting from the reference time when the drum position sensor 20 detects the mark 4, and the times when the photo receiver 42 detects the developed pattern images on the intermediate transfer belt are determined at the reference position where the pattern images are detected by the photo receiver 42 has been explained. However, when the moving speed of the intermediate transfer belt is uneven and/or the average moving speed thereof is uneven due to expansion or shrinkage of the driving roller, an error in detection of the reference position occurs. Therefore, it is preferable that a home toner mark is formed on the intermediate transfer belt independently of the pattern images. In this case, the detection of the pattern images is performed on the basis of this home toner mark. In this case, the relationship in phase between the time when the home toner mark is written and the time when the drum position sensor 20 detects the mark 4 is predetermined. It is necessary to reflect the thus determined relationship to the phase in the drive control correction operation.

In the image forming apparatus of the present invention, even when the relationship in position (i.e., the phase difference $\phi$) between the image writing position SP and the image transfer position TP is changed, the drive control correction value for use in correcting the variation in moving speed of the surface of the photoreceptor drum can be determined with high precision from the detection data of the pattern images formed on the intermediate transfer belt.

Figure 10:
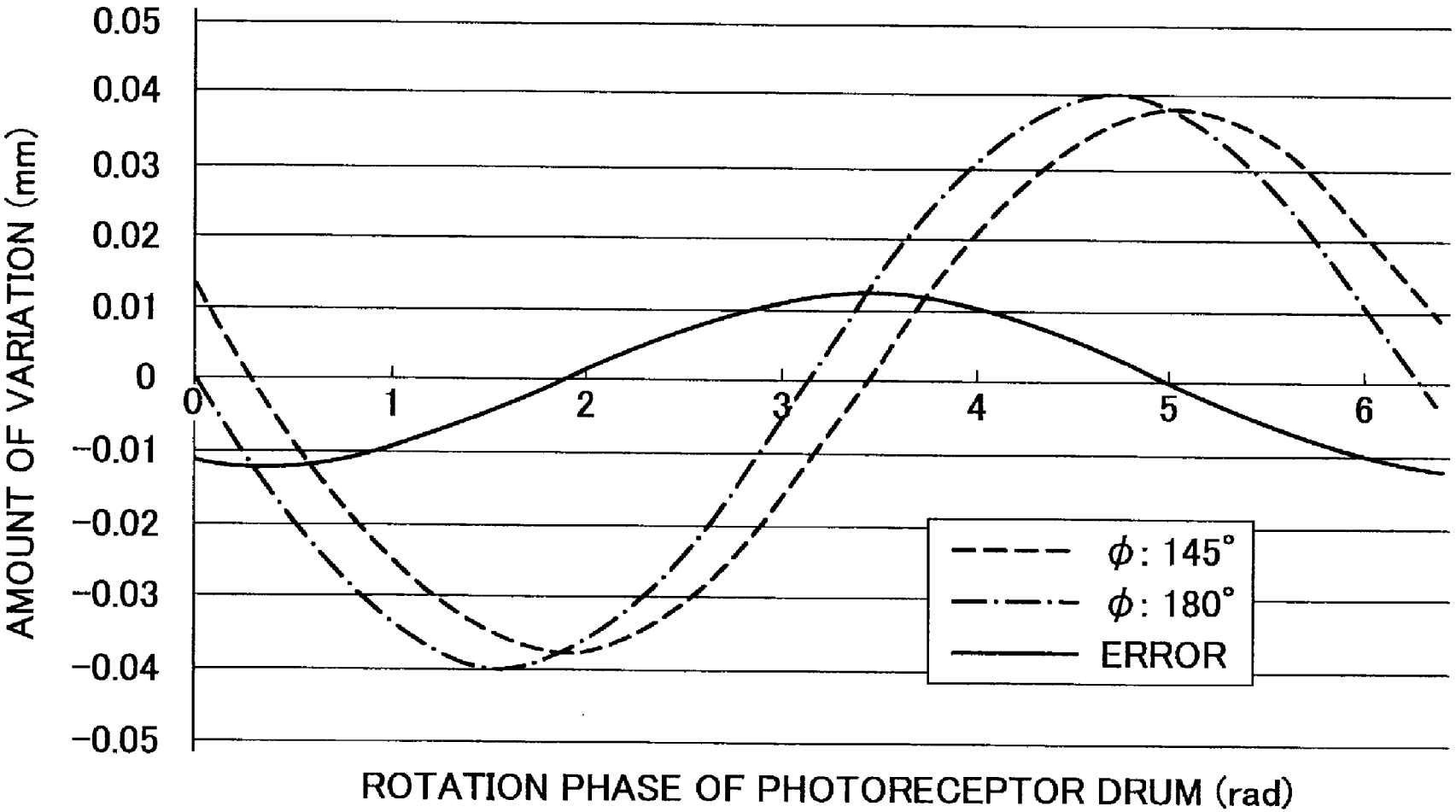
FIG. 10 is a graph illustrating the correction value obtained by using a conventional technique.

In the above-mentioned conventional technique described in JP-A 10-78734, the angle between the image writing position SP and the image transfer position TP is set to 180°, which is different from the real phase difference angle $\phi$. In this case, the error in determining the drive control correction value can be determined as the difference between the values obtained calculating equation (16) on the basis of the angle of 180° and the real angle $\phi$. Specifically, in a case where the radius (R) of the photoreceptor drum is 20 mm, the variation in rotation angular speed is represented by a sine wave having a cycle of one revolution of the photoreceptor drum and is varied at a rate ($\Delta\omega/\omega_o$) of 0.1%, and $\alpha$ is 0, the values obtained by calculating equation (16) on the basis of the angle of 3.14 radian (180°) and the real angle 2.53 radian (145°) are illustrated in FIG. 10. In FIG. 10, the difference therebetween is also illustrated. It can be understood from FIG. 10 that even when the phase difference between the position SP and the position TP is 35° (180-145) in angle and the variation of the rotation angular speed is as small as 0.1%, the position of the pattern images varies up to about 12 μm. By using the conventional technique, such an error occurs in drive controlling correction. In contrast, the image forming apparatus of the present invention can perform drive controlling correction with high precision (i.e., without making such an error).

In addition, hereinbefore variation in moving speed of the surface of the photoreceptor drum caused by a variation component having a cycle identical to one revolution of the photoreceptor drum has been explained. However, drive control correction values for variations in moving speed of the surface of the photoreceptor drum caused by other variation components can be similarly determined. For example, when a drive transmission mechanism in which a pulley provided on the shaft of the driving motor and a pulley provided on the shaft of the photoreceptor drum are connected with a stretched timing belt is used, the correction value can be determined by performing the above-mentioned processing using a converted rotation cycle ($\phi$tb) of the timing belt which is determined by converting the rotation cycle ($\omega$tb) of the timing belt and the phase difference p between the positions SP and TP. In this case, it is necessary to form a mark on the timing belt and to provide a position sensor configured to detect the mark. In this regard, if the timing belt does not slip from the pulley of the photoreceptor drum, a mark may be formed on the pulley of the photoreceptor drum so that the time when the mark is detected is set as the reference time of the timing belt.

Next, another example using another image forming unit will be explained by reference to FIG. 11. This example is hereinafter referred to as a modified example 1.

In recent years, a need exists for a small-sized image forming unit having both good durability. An image forming unit 80 of modified example 1 is illustrated in FIG. 11. The image forming unit 80 has a photoreceptor drum 85 having a diameter larger than that of the photoreceptor drum of a conventional image forming unit so that the photosensitive layer of the photoreceptor drum has higher durability. In addition, a cleaning device 81, a charging device 82, a light irradiating device 83 using a line LED, and a developing device 84 are provided on the left side of the photoreceptor drum (i.e., on the left side of a virtual plane VP (i.e., a tangential plane of the photoreceptor vertical to the surface of an intermediate transfer belt 86)). Therefore, the interval LST between two adjacent image forming units can be decreased, and thereby the size of the image forming units in the horizontal direction can be reduced. In such an image forming apparatus, the angle (phase difference) $\phi 1$ is largely different from 180°. In this modified example 1, the angle $\phi 1$ is 120°. In such an image forming apparatus, the drive control correction value can be determined with high precision by the above-mentioned method.

Figure 11:
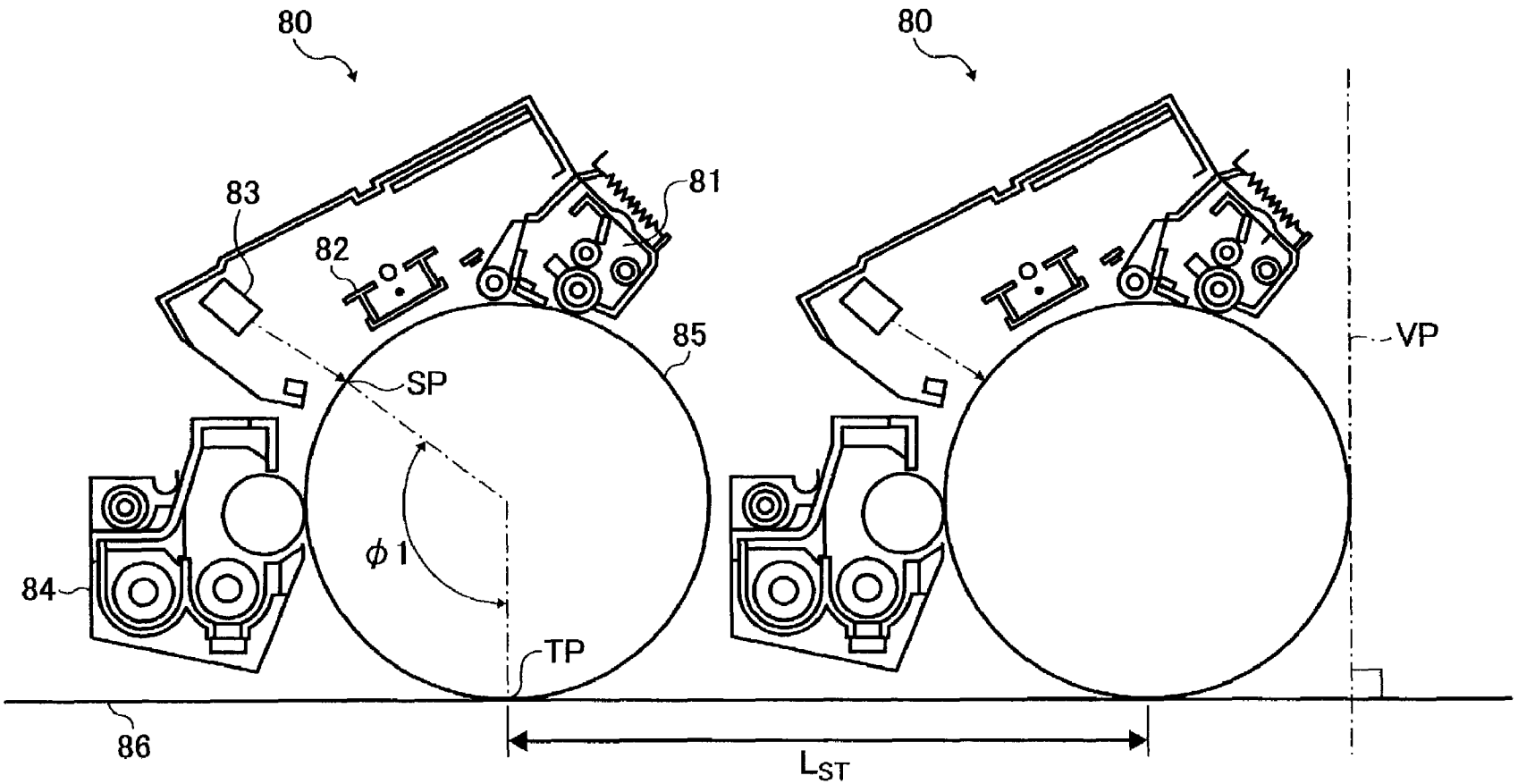
FIGS. 11 and 12 are schematic views illustrating other examples of the image forming unit of the image forming apparatus of the present invention.

In FIG. 11, only two image forming units 80 are illustrated. However, it is possible to provide four image forming units similarly to the image forming apparatus illustrated in FIG. 1 to produce full color images. In addition, it is possible to produce full color images using three image forming units. Further, in FIG. 11, the image forming units 80 are arranged over the intermediate transfer belt 86, but the image forming units 80 may be arranged under the intermediate transfer belt 86.

Next, another modified example (modified example 2) in which the photoreceptor drum of a black image forming unit has a larger diameter than the other photoreceptor drums will be explained by reference to FIG. 12.

In this modified example 2, the angle formed by the image writing position SP and the image transfer position TP in an image forming unit is different from that in another image forming unit. In a color image forming apparatus, the volume of monochrome images (black and white images) produced by a black image forming unit is generally larger than that of color images. Therefore, in this modified example 2, a black image forming unit 90K includes a photoreceptor drum 92 having a larger diameter than another photoreceptor drum 91 of another color image forming unit 90. Therefore, the photoreceptor drum 92 has better durability. Similarly to the image forming units illustrated in FIG. 11, the peripheral devices are provided on the left side of the photoreceptor drum 92 to reduce the size of the black image forming unit 90K. Since the same materials are used for the photosensitive layers of the photoreceptors 91 and 92, it is preferable that the distance between the image writing position and the developing position and the distance between the developing position and the image transfer position in the black image forming unit 90K are the same as those in the color image forming unit 90 so that the charge transport phenomenon and the toner transfer phenomenon can be similarly performed in the image forming units 90 and 90K. Therefore, the angle (phase difference) $\phi 3$ formed by the position SP and the position TP in the black image forming unit 90K is different from the phase difference $\phi 2$ in the color image forming unit 90. Since the above-mentioned correction operation can be performed on each of the image forming units, the above-mentioned method for determining the drive control correction value can be applied to such an image forming apparatus.

Figure 12:
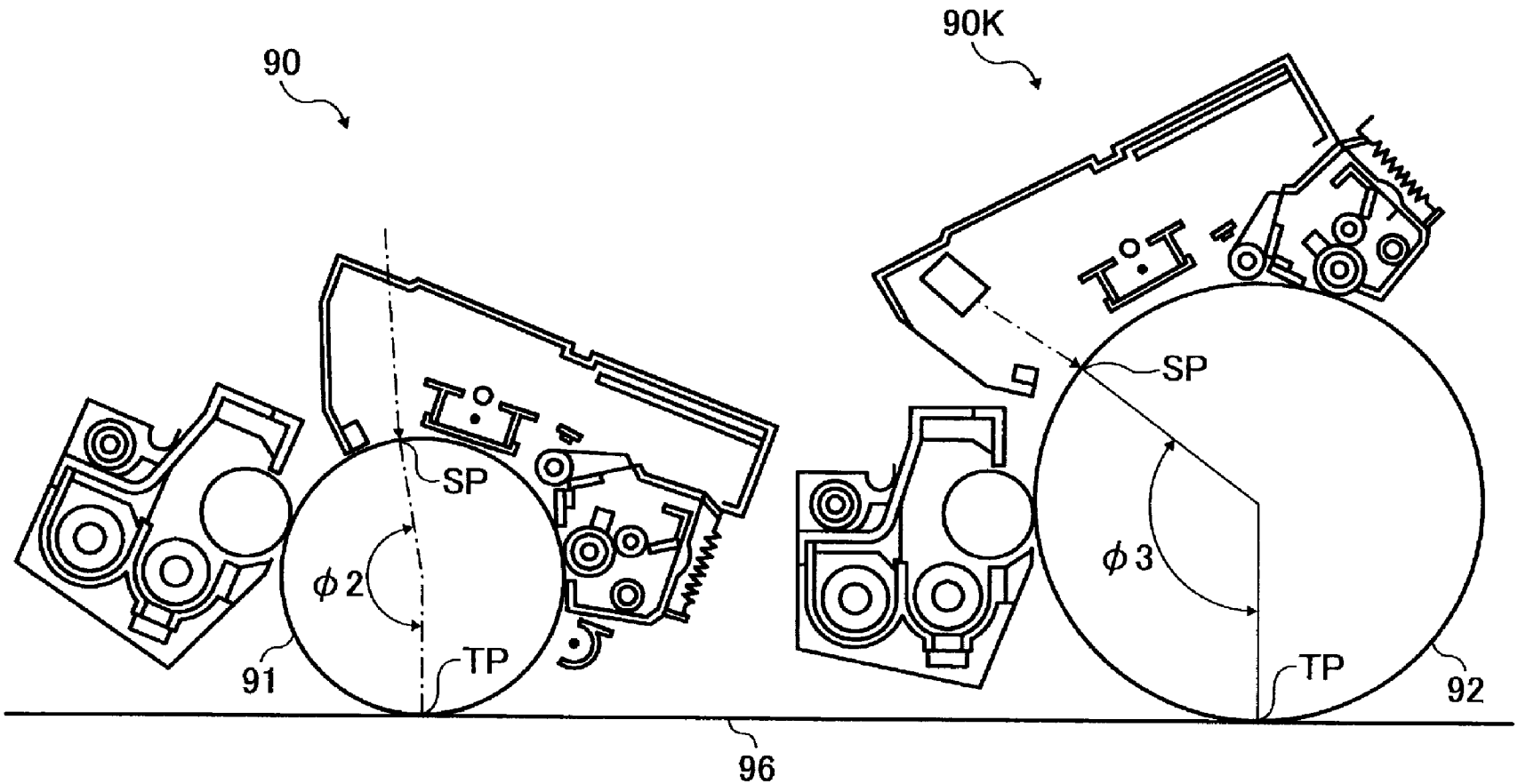

In FIG. 12, only the black image forming unit 90K and another color image forming unit 90 are illustrated. However, a combination of the black image forming unit 90K and two or three color image forming units 90 can also be used. Further, in FIG. 12, the image forming units 90 and 90K are arranged over an intermediate transfer belt 96, but the image forming units 90 and 90K may be arranged under the intermediate transfer belt 96.

Next, another modified example (modified example 3) using a belt-form photoreceptor will be explained by reference to FIG. 13.

The above-mentioned examples (including modified examples 1 and 2) use a photoreceptor drum as the image bearing member. However, in this modified example 3, a belt-form photoreceptor is used as the image bearing member. The above-mentioned method can be used for such an image forming apparatus as long as the image bearing member is a moving member having an image writing position SP and an image transfer position TP. Therefore, the above-mentioned method can be applied to the image forming apparatus of this modified example 3.

Figure 13:
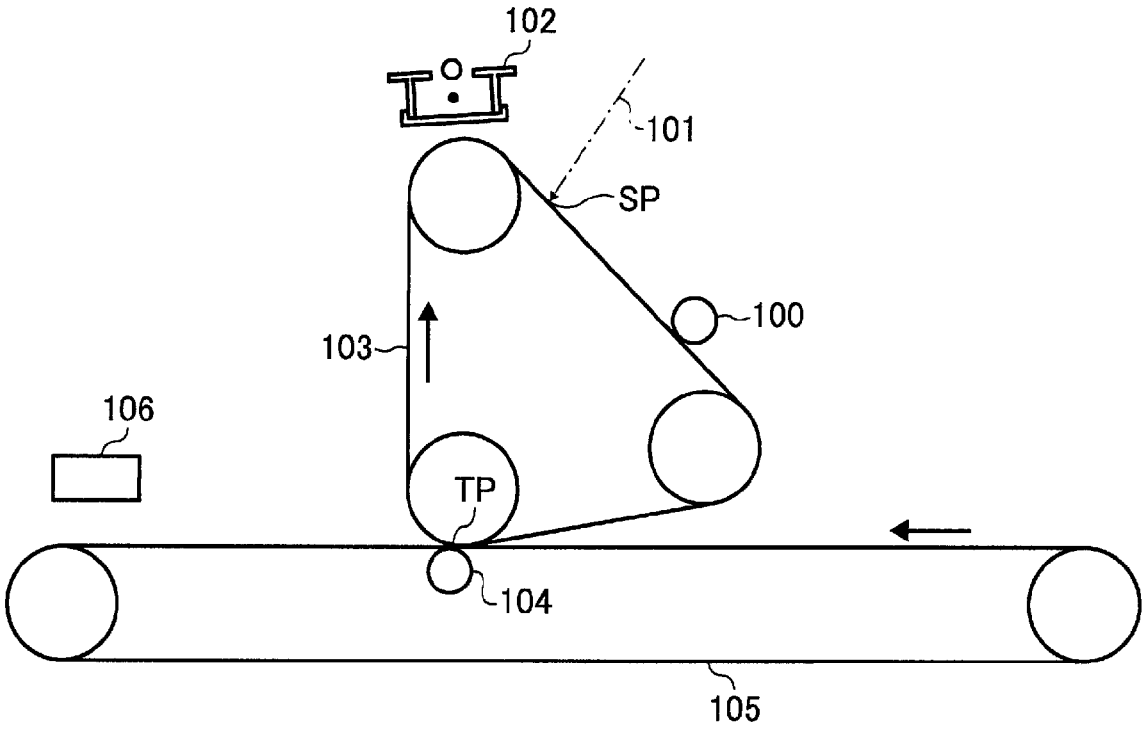
FIG. 13 is a schematic view illustrating another example of the image forming apparatus of the present invention, which uses a belt photoreceptor.

Referring to FIG. 13, a photoreceptor belt 103 is supported by three support rollers while tightly stretched, and is endlessly rotated in a direction indicated by an arrow by one of the three rollers. The photoreceptor belt 103 is contacted with an intermediate transfer belt 105 at a point TP at which the lowest support roller is contacted with a transfer roller 104 with the intermediate transfer belt 105 therebetween. Around the photoreceptor belt 103, a charging device 102 configured to charge the photoreceptor belt 103, a light irradiating device (not shown) configured to irradiate the charged photoreceptor belt 103 with imagewise light 101 at a position SP to form an electrostatic latent image on the photoreceptor belt 103, a developing device 100 configured to develop the electrostatic latent image with a developer including a toner to form a toner image on the photoreceptor belt 103, and the transfer roller 104 configured to transfer the toner image on the photoreceptor belt 103 to the intermediate transfer belt 105. The transfer roller 104 is provided inside the intermediate transfer belt 105 so as to be contacted with the lowest support roller with the intermediate transfer belt 105 therebetween.

Similarly to the cases mentioned above, detection pattern images are formed on the intermediate transfer belt 105, and the pattern images are detected by a pattern sensor 106. When such a belt-form photoreceptor is used, the moving speed of the belt-form photoreceptor is varied due to eccentricity of the driving roller and variation in thickness of the belt-form photoreceptor. In order to correct the variation in moving speed of the belt-form photoreceptor per one revolution of the belt-form photoreceptor, the drive control correction value can be similarly determined on the basis of the rotation angular speed $\omega ob$ and the phase difference angle $\phi ob$ formed by the image writing position SP and the image transfer position TP. In this regard, the parameters of the belt-form photoreceptor 103 corresponding to the radius R and the rotation angular speed $\omega$ of the photoreceptor drum can be determined on the basis of the peripheral length and the moving speed of the belt-form photoreceptor 103.

As mentioned above, the image forming apparatus of the present invention (e.g., the image forming apparatus of the above-mentioned examples and modified examples) can determine the drive control correction value with high precision regardless of the phase difference $\phi$ formed by the image writing position SP and the image transfer position TP. Therefore, the layout of the peripheral devices to be arranged around an image bearing member can be freely designed because the phase difference $\phi$ can be set so as to be largely different from 180°. This brings the following advantages.

Specifically, in an image forming apparatus (such as the image forming apparatus described in JP-A 10-78734) in which the phase difference $\phi$ is 180°, the variation in moving speed of the surface of the photoreceptor drum (for example, variation caused by changes of constitutional parts due to changes of environmental conditions and repeated use) is maximized. For example, when the variation in rotation angular speed of the photoreceptor drum per one revolution thereof is maximum at the image writing position SP, the interval between two adjacent pattern images formed at the image writing position SP is larger than the ideal interval. When the pattern images are transported to the image transfer position TP, the variation in rotation angular speed of the photoreceptor drum is decreased and has a minimum value at the image transfer position TP because the phase difference $\phi$ is 180°. Therefore, the moving speed of the photoreceptor drum relative to the moving speed of the intermediate transfer belt is slowest at the image transfer position TP, and thereby the interval between two adjacent pattern images further widens on the intermediate transfer belt. In this regard, the larger the difference between the phase difference $\phi$ and 180°, the smaller the variation in position (misalignment). In the image forming apparatus, the phase difference $\phi$ can be set to an angle far apart from 180°, and thereby the variation in position can be reduced.

In addition, the image forming apparatus of the present invention has the following advantage.

In the image forming apparatus, the second transfer nip is formed in the middle of a sheet feeding passage, which is designed so that the length of the passage is minimized to enhance the printing speed and to miniaturize the image forming apparatus. It is necessary for such an image forming apparatus to arrange the light irradiating device below the image forming units 1. In this case, if the phase difference $\phi$ is 180°, a problem in that toner particles are deposited on the irradiation lens, resulting in deterioration of qualities of the latent images formed on the photoreceptor drum by light beams passing through the irradiation lens occurs. In contrast, the phase difference $\phi$ is 145° in the image forming apparatus illustrated in FIG. 1, and therefore the image writing positions SP are located so as not to be right below the respective photoreceptor drums. In addition, the surface of the irradiation lens is slanted and therefore toner particles fallen on the lens slip from the surface of the lens. Therefore, the fallen toner particles are hardly deposited on the surface of the lens.

Further, the image forming apparatus of the present invention has the advantages mentioned above in the modified examples.

Hereinbefore, the present invention has been explained by reference to drawings. However, the present invention is not limited thereto. For example, the present invention can be applied to tandem image forming apparatus using a direct image transfer method as well as the above-mentioned tandem image forming apparatus using an intermediate transfer medium. In tandem image forming apparatus using a direct image transfer method, a receiving material sheet is fed by a feeding member serving as a moving member. In this case, the pattern images are formed on the surface of the feeding member, and the pattern images are detected by a pattern detection device.

In tandem image forming apparatus, the order of the image forming units is not particularly limited. In addition, the technique of the present invention can be applied to a monochrome image forming apparatus having only one image forming unit. Further, the peripheral devices such as developing devices and light irradiating devices are not particularly limited. Needless to say, the image forming apparatus of the present invention can be applied to copies, facsimiles and multi-functional machines having two or more functions as well as printers.

This document claims priority and contains subject matter related to Japanese Patent Application No. 2006-193028, filed on Jul. 13, 2006, incorporated herein by reference.

Having now fully described the invention, it will be apparent to one of ordinary skill in the art that many changes and modifications can be made thereto without departing from the spirit and scope of the invention as set forth therein.

What is claimed is:

1. An image forming apparatus comprising:

at least one image bearing member which is a rotating member and on which an electrostatic latent image is formed at an image writing position;

at least one image forming device configured to form the electrostatic latent image on the at least one image bearing member and to develop the electrostatic latent image with a developer including a toner to form a toner image on the at least one image bearing member;

a transfer device configured to transfer the toner image onto a receiving material, said transfer device including a moving member selected from a feeding member configured to feed the receiving material so that the toner image on the at least one image bearing member is transferred onto the receiving material at an image transfer position, and an intermediate transfer medium configured to receive the toner image from the at least one image bearing member at an image transfer position and to transfer the toner image to the receiving material;

a drive controller configured to control driving of the at least one image bearing member so that a rotation angular speed of the at least one image bearing member is identical to a targeted rotation angular speed;

a pattern detection device configured to detect plural detection pattern images formed on the moving member in a moving direction thereof by forming plural electrostatic latent images of the plural detection pattern images on the at least one image bearing member, developing the plural electrostatic latent images with the developer to form plural detection pattern toner images on the at least one image bearing member, and then transferring the detection pattern toner images onto the moving member at the image transfer position;

a second rotating member influencing an interval of the pattern toner images; and a correction device configured to correct the targeted rotation angular speed in such a manner that a pattern interval variation component representing a periodical variation in moving speed of the at least one image bearing member is extracted from a data of the detection pattern images; the thus extracted pattern interval variation component is corrected on the basis of a phase difference representing an angle between a first virtual line connecting the image writing position and a rotation center of the at least one image bearing member and a second virtual line connecting the image transfer position and the rotation center of the at least one image bearing member to determine an amount of variation in rotation angle or rotation angular speed per one revolution of the at least one image bearing member; the targeted rotation angular speed is corrected by superimposing a correction value, which is an inversion value negating the variation in rotation angle or rotation angular speed per one revolution of the at least one image bearing member on the targeted rotation angular speed, wherein the correction device is configured to repeat correction processing for the extracted pattern interval variation component (N-1) times to obtain an average of the variation in rotation angle or rotation angular speed per one revolution of the at least one image bearing member, a product of N and the phase difference being substantially identical to a product of M and $2\pi$, M and N being positive integers, and the average is used as the variation in rotation angle or rotation angular speed per one revolution of the at least one image bearing member, and the detection pattern toner images are formed at regular time intervals throughout a length that is a common multiple of a peripheral length of the second rotating member and a peripheral length of the at least one image bearing member.

2. The image forming apparatus according to claim 1, wherein the correction device corrects the extracted pattern interval variation component on the basis of the phase difference and conditions of transfer of the plural detection pattern toner images from the at least one image bearing member and the moving member to determine the variation in rotation angle or rotation angular speed per one revolution of the at least one image bearing member.

3. The image forming apparatus according to claim 1, wherein the at least one image bearing member has a cylindrical form.

4. The image forming apparatus according to claim 1, wherein the at least one image bearing member includes:

an endless belt; and plural rotating members configured to rotate and support the endless belt, wherein at least one of the plural rotating members is a driving member configured to drive the endless belt, and wherein the drive controller controls driving of the driving member according to information on rotation of at least one of the plural rotating members so that the endless belt moves at the targeted rotation angular speed.

5. The image forming apparatus according to claim 1, wherein the at least one image bearing member includes:

an endless belt; and plural rotating members configured to rotate and support the endless belt, wherein at least one of the plural rotating members is a driving member configured to drive the endless belt, and wherein the correction device performs correction processing while regarding the endless belt as a cylindrical image bearing member, wherein an average of the rotation angular speed of the cylindrical image bearing member and a radius of the cylindrical image bearing member are calculated from a peripheral length of the endless belt and an average moving speed of the endless belt.

6. The image forming apparatus according to claim 1, including a plurality of units each including an image bearing member and an image forming device, wherein the plurality of units are arranged side by side in a moving direction of the moving member, and wherein in each unit the image forming device is located on one side from a tangential plane of the corresponding image bearing member, said tangential plane being vertical to a surface of the moving member.

7. The image forming apparatus according to claim 1, including a plurality of image bearing members, which are arranged side by side in a moving direction of the moving member, wherein at least one of the plurality of image bearing members is different in peripheral length from the other image bearing members.

8. The image forming apparatus according to claim 1, wherein the image forming device includes a light irradiating device configured to irradiate a surface of the at least one image bearing member with imagewise light obliquely from below to form the electrostatic latent image thereon.

9. An image forming method, comprising:

forming electrostatic latent detection pattern images on a rotating member at an image writing position while rotating the rotating member at a targeted rotation angular velocity, the latent detection pattern images formed at regular time intervals throughout a length that is a common multiple of a peripheral length of a second rotating member and a peripheral length of the rotating member, the second rotating member being a member that influences an interval of the latent detection pattern images;

developing the electrostatic latent detection pattern images with a developer including a toner to form detection pattern toner images on the rotating member;

transferring the detection toner images on the rotating member to a moving member at an image transfer position;

extracting a pattern interval variation component representing a periodical variation in moving speed of the rotating member from a data of the detection pattern toner images;

correcting the extracted pattern interval variation component on the basis of a phase difference representing an angle between a first virtual line connecting the image writing position and a rotation center of the rotating member and a second virtual line connecting the image transfer position and the rotation center of the rotating member to determine an amount of variation in rotation angle or rotation angular speed per one revolution of the rotating member; and correcting the targeted rotation angular velocity by superimposing a correction value, which is an inversion value negating the variation in rotation angle or rotation angular speed per one revolution of the rotating member on the targeted rotation angular velocity, wherein the extracting a pattern interval variation component and the correcting the extracted pattern interval variation component are repeated (N-1) times to obtain an average of the variation in rotation angle or rotation angular speed per one revolution of the rotating member, a product of N and the phase difference being substantially identical to a product of M and $2\pi$, M and N being positive integers, and the average is used as the variation in rotation angle or rotation angular speed per one revolution of the rotating member.

* * * * *